US010403233B2

(12) United States Patent
Saito

(10) Patent No.: US 10,403,233 B2
(45) Date of Patent: Sep. 3, 2019

(54) IMAGE PROCESSING APPARATUS AND IMAGE PROCESSING METHOD

(71) Applicant: CANON KABUSHIKI KAISHA, Tokyo (JP)

(72) Inventor: Tetsuji Saito, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/869,811

(22) Filed: Jan. 12, 2018

(65) Prior Publication Data

US 2018/0204542 A1 Jul. 19, 2018

(30) Foreign Application Priority Data

Jan. 17, 2017 (JP) ..... 2017-005877
Dec. 8, 2017 (JP) ..... 2017-235996

(51) Int. Cl.
*G09G 5/10* (2006.01)
*G09G 5/14* (2006.01)

(52) U.S. Cl.
CPC ..... *G09G 5/10* (2013.01); *G09G 5/14* (2013.01); *G09G 2320/0271* (2013.01); *G09G 2320/0613* (2013.01); *G09G 2320/0626* (2013.01); *G09G 2320/0673* (2013.01); *G09G 2320/0686* (2013.01); *G09G 2320/08* (2013.01); *G09G 2330/021* (2013.01); *G09G 2340/12* (2013.01); *G09G 2360/144* (2013.01); *G09G 2360/16* (2013.01); *G09G 2370/04* (2013.01)

(58) Field of Classification Search
USPC ..... 345/589
See application file for complete search history.

(56) References Cited

U.S. PATENT DOCUMENTS

2015/0356904 A1* 12/2015 Nakatani ..... G09G 5/377 345/690
2016/0180761 A1* 6/2016 Sasaki ..... G09G 3/36 345/691
2017/0061894 A1* 3/2017 Ikeda ..... G09G 5/003
2018/0033400 A1* 2/2018 Nagashima ..... G06T 5/007

FOREIGN PATENT DOCUMENTS

JP 2009-005258 A 1/2009

* cited by examiner

*Primary Examiner* — Wesner Sajous
(74) *Attorney, Agent, or Firm* — Cowan, Liebowitz & Latman, P.C.

(57) ABSTRACT

An image processing apparatus according to the present invention, includes: a determination unit configured to determine, based on a layout of at least one image included in display image data, a display correspondence, which is a correspondence between a gradation value of the display image data and a display brightness in a case where a display unit displays an image based on the display image data; and an output unit configured to output to the display unit the display image data and information indicating the display correspondence.

21 Claims, 15 Drawing Sheets

IMAGE PROCESSING APPARATUS AND IMAGE PROCESSING METHOD

BACKGROUND OF THE INVENTION

Field of the Invention

The present invention relates to an image processing apparatus and an image processing method.

Description of the Related Art

Recently HDR image data has come to be used widely due to the improvement in the performance of image sensors, advancement in technology related to image processing, and the like. HDR image data is image data corresponding to a high dynamic range (HDR). For example, HDR image data is image data of which color depth is greater than 8 bits. And the dynamic range is, for example, a range of possible gradation values or a range of possible brightness.

As the performance of the display apparatus improves, techniques to implement a high brightness display have started to be proposed. For example, along with the improvement in the performance of light emitting diode (LED), which is used for the light source of a backlight unit for a liquid crystal display apparatus, techniques to implement a high brightness display by controlling the emission brightness of the backlight unit are being proposed. A technique to implement a high brightness display for each of a plurality of pixels independently using an organic light emitting diode (OLED; an organic electro luminescence (EL) element) has also been proposed.

For example, when HDR image data is created, assuming that this image data is displayed on a display apparatus which can implement a high brightness display, a user who forms the image creates the HDR image data such that a small sized white image stands out on the screen. In concrete terms, the user determines the brightness change between frames, the brightness change between scenes, the maximum brightness of each frame, the maximum brightness of each scene and the like, so that a small sized white image stands out on the screen. In future, it is expected that HDR image data, to be displayed on a display apparatus which can implement a high brightness display, will be popular.

HDR image data is generated based on various standards, such as SMPTE ST2084 and Hybrid Log Gamma (HLG). HLG is a standard in which the brightness value is handled as a relative brightness defined by a gamma curve, which can support conventional TV apparatuses as well. SMPTE ST2084 is a brightness information recording standard for the content of HDR, which is standardized by SMPTE, and SMPTE ST2084 is a standard in which brightness up to 10,000 nit is handled as the absolute brightness. In SMPTE ST2084, the correspondence between a gradation value and brightness is defined using a perceptual quantizer (PQ) curve. A characteristic of the SMPTE ST2084 and HLG is that the brightness of the HDR image data is handled as the display brightness of the display apparatus.

HDR10 is a standard defined in SMPTE ST2084. In HDR10, maximum content light level (MaxCLL) and maximum frame average light level (MaxFALL) are attached as meta data, which is static data. MaxCLL is meta data which defines the maximum brightness of the HDR image data, and MaxFALL is meta data which defines the average brightness of the HDR image data. The authoring guide line of HDR10 specifies that the image region exceeding 1000 nit is limited to a small sized image region, such as an image region of specular reflection. It also specifies that the average brightness is not more than 400 nit.

Further, as the standard of the HDR image data, a new standard, other than the above mentioned standards, may be independently defined by a camera manufacturer, a display manufacturer, an image distributor or the like in the future, and the HDR image data may be generated using such an independent standard.

The HDR image data, which has a plurality of standards and a plurality of systems, is accessible to a user via a network, or is recorded on a Blu-ray disk or the like. When HDR image data is increasingly made available to users, HDR image data will likewise be displayed more frequently on display apparatuses.

In some cases, a plurality of images based on a plurality of image data is displayed on the screen of the same display apparatus. A technique to display a plurality of images on the same screen is disclosed in, for example, Japanese Patent Application Publication No. 2009-005258. According to the technique disclosed in Japanese Patent Application Publication No. 2009-005258, image processing that is performed on image data of each one of the plurality of images is changed in accordance with the display size (size of the image on the screen). The plurality of image data may include conventional standard dynamic range (SDR) image data, which is defined in the REC. 709 and of which the upper limit of brightness is 100 nit, and HDR image data. The plurality of image data may also include two or more HDR image data, of which standards and upper limits of brightness and the like are different from each other. In such cases, a plurality of image processing operations having mutually different correspondences of gradation value of the image data and the display brightness of the display apparatus (brightness on screen) may be performed for the plurality of image data respectively.

SUMMARY OF THE INVENTION

However, in the case of the technique disclosed in Japanese Patent Application Publication No. 2009-005258, a plurality of image processing operations must be performed for a plurality of image data respectively, hence the circuit scale of the image processing, the processing load of the image processing and the like, increase. Further, if high brightness image data, such as 10,000 nit, is constantly displayed at a 10,000 nit display brightness, the user may have difficulty in seeing other images.

The present invention in its first aspect provides an image processing apparatus, comprising:

a determination unit configured to determine, based on a layout of at least one image included in display image data, a display correspondence, which is a correspondence between a gradation value of the display image data and a display brightness in a case where a display unit displays an image based on the display image data; and an output unit configured to output to the display unit the display image data and information indicating the display correspondence.

The present invention in its second aspect provides an image processing method, comprising:

determining, based on a layout of at least one image included in display image data, a display correspondence, which is a correspondence between a gradation value of the display image data and a display brightness in a case where a display unit displays an image based on the display image data; and outputting to the display unit the display image data and information indicating the display correspondence.

The present invention in its third aspect provides a non-transitory computer readable medium that stores a program, wherein the program causes a computer to execute:

determining, based on a layout of at least one image included in display image data, a display correspondence, which is a correspondence between a gradation value of the display image data and a display brightness in a case where a display unit displays an image based on the display image data; and outputting to the display unit the display image data and information indicating the display correspondence.

The present invention in its fourth aspect provides an image processing apparatus configured to output display image data to a display unit configured to display an image based on the display image data, the apparatus comprising:

a generation unit configured to generate the display image data by disposing at least one window corresponding to at least one application to display an image; and a control unit configured to control an upper limit value of the display brightness of the display unit in accordance with the disposition of at least one window in the display image data, wherein the control unit performs control so that the upper limit value of the display brightness is higher in a case where a predetermined window corresponding to an application to display an HDR image satisfies a predetermined condition in the display image data than in other cases.

Further features of the present invention will become apparent from the following description of exemplary embodiments with reference to the attached drawings.

DESCRIPTION OF THE EMBODIMENTS

EXAMPLE 1

Example 1 of the present invention will be described. In the following description, an image processing apparatus, according to this example, is assumed to be an apparatus that is separate from a display apparatus.

The image processing apparatus is a personal computer (PC), a regeneration apparatus (e.g. Blu-ray player) or a server apparatus, for example. The display apparatus is a liquid crystal display apparatus, an organic electro luminescence (EL) display apparatus, a plasma display apparatus, a microelectromechanical system (MEMS) shutter type display apparatus, or a projector, for example.

The image processing apparatus and the display apparatus may be integrated. A display apparatus having an image processing apparatus is a smartphone, a tablet terminal, a notebook PC or a TV apparatus, for example.

Figure 1:
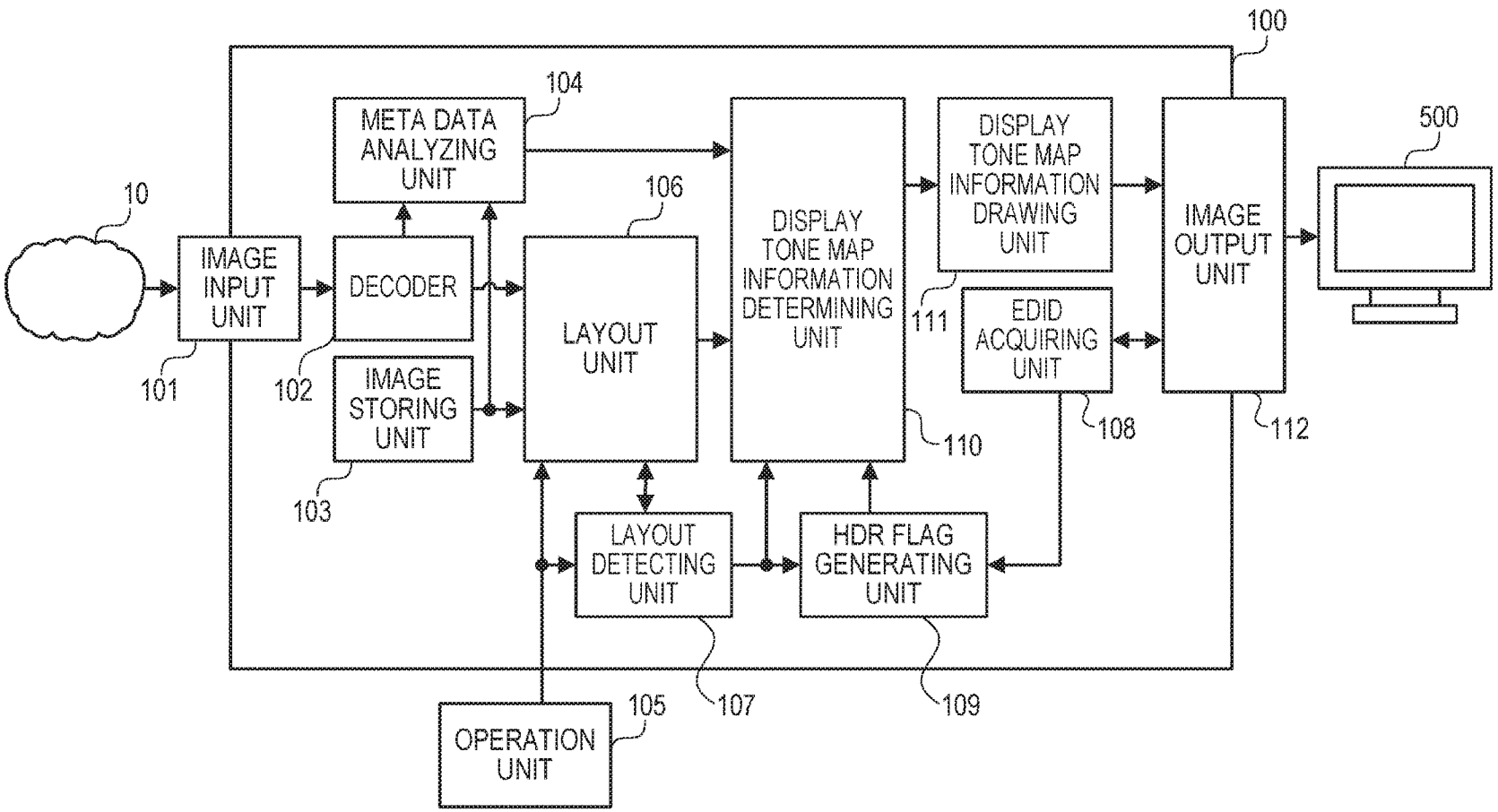
FIG. 1 is a configuration example of an image processing apparatus according to Example 1.

FIG. 1 is a block diagram depicting a configuration example of the image processing apparatus 100 according to this example. The image processing apparatus 100 includes: an image input unit 101, a decoder 102, an image storing unit 103, a meta data analyzing unit 104, an operation unit 105, a layout unit 106, a layout detecting unit 107, and an EDID acquiring unit 108. Furthermore, the image processing apparatus 100 includes: an HDR flag generating unit 109, a display tone map information determining unit 110, a display tone map information drawing unit 111, and an image output unit 112.

The image processing apparatus 100 generates display image data which includes at least one image, and determines display correspondence, which is a correspondence between the gradation value of the display image data and the display brightness of the display apparatus 500. The image processing apparatus 100 outputs the display image data and information to indicate the display correspondence (tone map information; display tone map information) to the display apparatus 500. The display tone map information is, for example, information on the upper limit display brightness based on the display correspondence, a function to indicate the display correspondence, a table to indicate the display correspondence, or an identifier to indicate the display correspondence. The display apparatus 500 displays an image based on the display image data on the screen in accordance with the display tone map information (display correspondence).

The image processing apparatus 100 can be connected to a cloud (e.g. server apparatus) 10 using cloud computing. The display apparatus 500 is connected to the image processing apparatus 100 by cable or wirelessly. For example, the image processing apparatus 100 and display apparatus 500 are interconnected based on such standards as Display Port and High-Definition Multimedia Interface (HDMI). In this example, the upper limit of the display brightness (brightness on screen) of the display apparatus 500 is 2000 nit. The upper limit display brightness (upper limit of display brightness) is not especially limited. The upper limit display brightness may be higher than 2000 nit or lower than 2000 nit.

The image input unit 101 acquires the image data (input image data) from outside the image processing apparatus 100, and outputs the input image data to the decoder 102. In this example, the image input unit 101 acquires the input image data from the cloud 10. The image input unit 101 can acquire input image data in various data formats (e.g. systems, standards).

In this example, the input image data is HDR image data supporting the high dynamic range (HDR). For example, the HDR image data is image data assuming display by a display apparatus which can implement a high brightness display. The dynamic range is, for example, a range of possible gradation values or a range of possible brightness values. In this example, it is assumed that the HDR image data is an image data having a data format specified by the SMPTE ST2084 standard. Further, it is assumed that the information on the data brightness (brightness of an image (image data); brightness that is assumed in the image data) is attached as meta data to the HDR image data. The input image data is assumed to be HDR image data in which the gradation value is stated to be a 10-bit value (0 to 1023).

The data format of the input image data is not especially limited. The HDR image data may not conform to ST2084, and meta data may not be attached to the HDR image data. For example, the HDR image data may be image data in a data format specified by the Hybrid Log Gamma standard. The meta data may or may not be attached to the HDR image data alone. The number of bits of the gradation value of the HDR image data may be more than 10 bits, or less than 10 bits. For example, the gradation value of the HDR image data may be a 12-bit value. The input image data may not be HDR image data. The input image data may be still image data, or moving image data.

The method of acquiring the input image data is not especially limited. For example, the image input unit 101 may acquire the input image data without using cloud computing. The image input unit 101 may acquire the input image data from a regeneration apparatus, a storage apparatus (e.g. hard disk drive, solid-state drive) or the like, connected to the image processing apparatus 100 (image input unit 101). The image input unit 101 may acquire the input image data from an external apparatus via cable, or may acquire the input image data from an external apparatus wirelessly. The image processing apparatus 100 may include a reading unit (e.g. Blu-ray drive, memory card reader), which can read the input image data from a recording medium (e.g. optical disk, memory card). Then the image input unit 101 may acquire the input image data from the recording medium via the reading unit.

A decoder 102 decodes the input image data output from the image input unit 101. For example, a case when the input image data was acquired based on such a standard such as HDMI will be considered. In this case, the decoder 102 performs a processing to convert Transition Minimized Differential Signaling (TMDS) signals into image data, such as RGB data and YCbCr data. The decoder 102 extracts the meta data, which is attached to the input image data output from the image input unit 101, from this input image data. Then the decoder 102 outputs the meta data to the meta data analyzing unit 104, and outputs the decoded input image data to the layout unit 106.

The image storing unit 103 stores the image data. The image storing unit 103 is, for example, a magnetic disk, an optical disk or a semiconductor memory. The image storing unit 103 may be included in the image processing apparatus 100, or may be detachable from the image processing apparatus 100. The image storing unit 103 can store image data in various data formats (e.g. systems, standards).

In this example, the image storing unit 103 stores, for example, HDR image data, and standard dynamic range (SDR) image data, of which dynamic range is smaller than HDR image data. The SDR image data is, for example, image data of which upper limit data brightness (upper limit of data brightness) is conventionally 100 nit, which is defined in the REC. 709 standard. The image data may be a window corresponding to an application which the image processing apparatus 100 executed. For example, [the image data] may be an HDR window corresponding to the application for displaying an image by HDR, or an SDR window corresponding to the application for displaying an image by SDR.

In this example, the layout unit 106 reads the image data (stored image data) from the image storing unit 103, in response to the operation which the user performed using the image processing apparatus 100 (operation unit 105). If meta data is attached to the stored image data which was read from the image storing unit 103, the meta data analyzing unit 104 reads this meta data from the image storing unit 103.

The data format of the stored image data is not especially limited. For example, the image storing unit 103 may not store at least one of the HDR image data and the SDR image data. The stored image data may be still image data or may be moving image data.

The meta data analyzing unit 104 acquires information to indicate the data correspondence (tone map information; data tone map information) by analyzing meta data (meta data output from the decoder 102, or meta data read from the image storing unit 103). The data correspondence is a correspondence between the gradation value of the image data and the data brightness. The data tone map information is, for example, information on the upper limit data brightness, a function to indicate the data correspondence, a table to indicate the data correspondence, or an identifier to indicate the data correspondence. The meta data analyzing unit 104 outputs the acquired data tone map information to the display tone map information determining unit 110.

In this example, the information to indicate the upper limit data brightness is included in the meta data, and the information on the upper limit data brightness is acquired as the data tone map information. In concrete terms, the meta data analyzing unit 104 acquires the data tone map information to indicate the upper limit data brightness of the input image data by analyzing the meta data of the input image data. The meta data analyzing unit 104 acquires the data tone map information to indicate the upper limit data brightness of the stored image data by analyzing the meta data of the stored image data.

The method of acquiring the data tone map information is not especially limited. For example, the meta data analyzing unit 104 may acquire the data tone map information on the image data by analyzing the image data (each gradation value).

The operation unit 105 receives the operation which the user input to the image processing apparatus 100 (operation unit 105), and outputs the operation information in accordance with the performed operation. For example, the operation unit 105 receives the layout operation concerning the layout of the image in the display image data (e.g. input image indicated by the input image data, stored image indicated by the stored image data). Then the operation unit 105 outputs the operation information in accordance with the performed layout operation to the layout unit 106 and the layout detecting unit 107.

The layout operation is, for example, an operation to select image data to be displayed (e.g. input image data, stored image data), an operation to change the size of the displayed image (e.g. input image, stored image), and an operation to change the position of the displayed image. The layout operation also includes an operation to change the size of the window in which an image (e.g. input image, stored image) is displayed, and an operation to change the position of the window.

The operation unit 105 is, for example, a mouse and a keyboard. The operation unit 105 may be detachable from the image processing apparatus 100, or may not be detachable from the image processing apparatus 100. The operation unit 105 may be buttons disposed in the image processing apparatus 100, a touch panel disposed in the image processing apparatus 100 or the like. The operation unit 105 may be a remote controller which outputs the operation information to the image processing apparatus 100 wirelessly.

The layout unit 106 generates the display image data. In this example, the layout unit 106 generates the display image data in accordance with the operation information, which is output from the operation unit 105 using the input image data, the stored image data or the like, when necessary. In this example, a display image data in which an image (e.g. input image, stored image) is not disposed, a display image data in which at least one image is disposed, or a display data in which one image is disposed so as to be displayed on a full screen, for example, is generated. Then the layout unit 106 outputs the display image data to the display tone map information determining unit 110.

In this example, the layout of the image (e.g. input image, stored image) in the display image data is determined by the operation information. The method of determining the layout is not especially limited. For example, the layout unit 106 may determine the layout in accordance with the type of image data to be displayed (e.g. medical image, landscape, illustration, graph), or the operation mode (display mode) of the image processing apparatus 100.

The layout detecting unit 107 detects (confirms) the layout of the image in the display image data which is output from the layout unit 106, and outputs the layout information in the detection result to the HDR flag generating unit 109. As mentioned above, in this example, the layout of the image in the display image data is determined by the operation information. Therefore the layout detecting unit 107 confirms the layout in accordance with the output of the operation information from the operation unit 105 to the layout detecting unit 107.

The method of detecting the layout, the method of generating the layout information and the like are not especially limited. For example, the layout detecting unit 107 may detect the layout by analyzing the display image data. To detect the layout or to generate the layout information, the operation information, the data tone map information or the like may be used. The timing to detect the layout is not especially limited either. For example, the layout detecting unit 107 may analyze the display image data output from the layout unit 106, and detect the layout at a timing when the change in the display image data is detected. The layout detecting unit 107 may detect the layout at every predetermined time.

The Extended Display Identification Data (EDID) acquiring unit 108 acquires the EDID of the display apparatus 500 from outside the image processing apparatus 100. The EDID acquiring unit 108 generates the display performance information on the display performance of the display apparatus 500 based on the EDID, and outputs the display performance information to the HDR flag generating unit 109. The display performance information of the display apparatus 500 is, for example, information on the upper limit display brightness of the display apparatus 500, information on whether the display apparatus 500 supports HDR, information on the range of brightness which the display apparatus 500 can display, and information on the display correspondence which the display apparatus 500 can use.

In this example, the EDID acquiring unit 108 acquires the EDID, including the display performance information, from the display apparatus 500 via the image output unit 112, and extracts the display performance information from the EDID. The method of acquiring the display performance information is not especially limited. For example, based on the EDID, the EDID acquiring unit 108 may generate the display performance information of which data format is different from the information included in the EDID. A transmission path to acquire the EDID without using the image output unit 112 may be used. The EDID acquiring unit 108 may acquire the display performance information from outside the image processing apparatus 100 without acquiring the EDID. The EDID acquiring unit 108 may acquire the display performance information from an apparatus that is different from the display apparatus 500 (e.g. server apparatus). The display performance information may be recorded on the image processing apparatus 100 in advance.

The HDR flag generating unit 109 generates an HDR flag based on the layout information output from the layout detecting unit 107, the display performance information output from the EDID acquiring unit 108 or the like. Then the HDR flag generating unit 109 outputs the HDR flag to the display tone map information determining unit 110. The HDR flag is a flag corresponding to the display tone map information (display correspondence).

The display tone map information determining unit 110 determines a common (one) display correspondence on the screen of the display apparatus 500 based on the layout of at least one image (e.g. input image, stored image) which is included in the display image data output from the layout unit 106. In this example, the HDR flag is generated based on the layout (layout information). The display tone map information determining unit 110 determines the display tone map information (display correspondence) based on the HDR flag output from the HDR flag generating unit 109. Then the display tone map information determining unit 110 links the display image data, the display tone map information, and the data tone map information output from the meta data analyzing unit 104, and outputs the linked data to the display tone map information drawing unit 111.

Figure 4A:
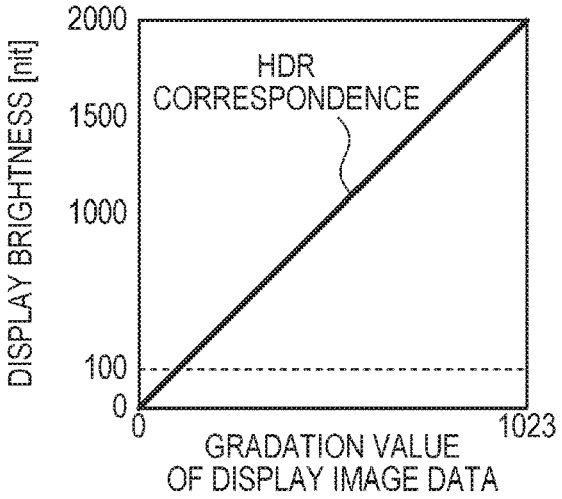
FIGS. 4A to 4C are examples of a display correspondence according to Example 1.
Figure 4B:
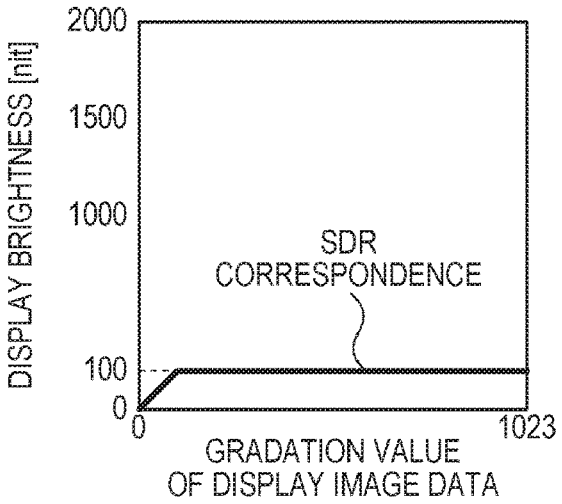
Figure 4C:
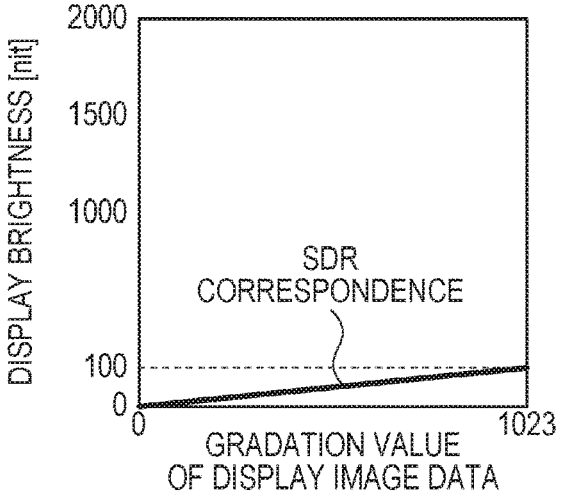

A concrete example of the display correspondence (display tone map information) will be described next with reference to FIGS. 4A to 4C. FIG. 4A is an example of the HDR correspondence (HDR tone map information), and FIGS. 4B and 4C are examples of the SDR correspondence (SDR tone map information). In FIGS. 4A to 4C, the ordinate indicates the display brightness, and the abscissa indicates the gradation value of the display image data.

In the HDR correspondence in FIG. 4A, the display brightness linearly increases from 0 nit to 2000 nit, as the gradation value increases from 0 to 1023. In the HDR correspondence in FIG. 4A, the upper limit display brightness is 2000 nit. In the SDR correspondence in FIGS. 4B and 4C, on the other hand, the upper limit display brightness is 100 nit. In the SDR correspondence in FIG. 4B, the display brightness linearly increases from 0 nit to 100 nit, as the gradation value increases from 0 to a predetermined value. For the gradation values not less than the predetermined value, a 100 nit display brightness is corresponded. In the SDR correspondence in FIG. 4C, the display brightness linearly increases from 0 nit to 100 nit, as the gradation value increases from 0 to 1023. In other words in the HDR correspondence, the upper limit value of the display brightness corresponding to the image data is higher than the case of the SDR correspondence.

The display correspondence is not limited to the display correspondences in FIGS. 4A to 4C. For example, in the display correspondence, the display brightness may have a non-linear change with respect to the change of the gradation value, in a part or all of the gradation value range.

In this example, the display tone map information determining unit 110 determines the HDR correspondence (first correspondence) as the display correspondence when the HDR flag is 1. In concrete terms, when the HDR flag is 1, the display tone map information determining unit 110 determines the HDR tone map information corresponding to the HDR correspondence as the display tone map information. In this example, the upper limit display brightness corresponding to the HDR tone map information (HDR correspondence) is approximately the same as the upper limit data brightness of the HDR image data. In concrete terms, the HDR tone map information is the data tone map information of the HDR image data which is output from the meta data analyzing unit 104. When the data tone map information is used as the display tone map information, the data correspondence corresponding to the data tone map information is handled as the display correspondence, and the data brightness corresponding to the data tone map information is handled as the data brightness. Therefore the upper limit display brightness corresponding to the HDR tone map information is the same as the upper limit data brightness of the HDR image data.

The HDR tone map information may be different from the data tone map information of the HDR image data. For example, the upper limit display brightness corresponding to the HDR tone map information may be different from the upper limit data brightness of the HDR image data. The HDR tone map information may be determined in advance. The display tone map information determining unit 110 may determine the upper limit display brightness corresponding to the HDR tone map information in accordance with the range of the brightness that the display apparatus 500 can display. For example, the upper limit display brightness of the display apparatus 500 may be determined as the upper limit display brightness corresponding to the HDR tone map information.

In this example, when the HDR flag is 0, the display tone map information determining unit 110 determines the SDR correspondence (second correspondence), of which the range of display brightness is different from the HDR correspondence, as the display correspondence. In concrete terms, when the HDR flag is 0, the display tone map information determining unit 110 determines the SDR tone map information corresponding to the SDR corresponding, as the display tone map information. The upper limit display brightness corresponding to the SDR tone map information (SDR correspondence) is lower than the upper limit display brightness corresponding to the HDR tone map information. For example, the upper limit display brightness corresponds to the SDR tone map information is 100 nit defined in the REC. 709 standard, which is conventionally used.

The display tone map information drawing unit 111 notifies the display correspondence determined by the display tone map information determining unit 110 to the user. In concrete terms, the display tone map information drawing unit 111 generates the graphic image data based on the display tone map information and the data tone map information which are output from the display tone map information determining unit 110. The graphic image represented by the graphic image data indicates the data correspondence, the display correspondence or the like of the image disposed in the display image data. The display tone map information drawing unit 111 combines the graphic image data with the display image data output from the display tone map information determining unit 110. Then the display tone map information drawing unit 111 links the combined display image and the display tone map information, and outputs the result to the image output unit 112.

In this example, the image based on the combined display image data is displayed on the display apparatus 500. Therefore the above mentioned graphic image is displayed on the screen of the display apparatus 500, and the display correspondence, the data correspondence or the like is notified to the user. The method of notifying the display correspondence, the method of notifying the data correspondence and the like are not especially limited. For example, this information may be notified to the user by outputting a voice prompt, turning on an indicator light or the like. At least one of the display correspondence and the data correspondence may not be notified. For example, the display tone map information drawing unit 111 may output the display image data, which was output from the display tone map information determining unit 110, directly to the image output unit 112. The graphic image may be displayed constantly, or may be display temporarily. For example, the display tone map information drawing unit 111 may combine the graphic image data so that the graphic image is displayed only for a predetermined time, from the timing when the display correspondence, layout or the like changed.

The image output unit 112 outputs the display image data and the display tone map information, which were output from the display tone map information drawing unit 111, to the display apparatus 500. In this example, the image output unit 112 converts the data format of the display image data and the display format of the display tone map information into a predetermined data format. The predetermined data format is, for example, a data format conforming to such standards as Display Port and High-Definition Multimedia Interface (HDMI). The image output unit 112 outputs the display image data after the data format was converted, and the display tone map information after the data format was converted, to the display apparatus 500.

The image output unit 112 may independently output the display image data and the display tone map information, or may output the display image data to which the display tone map information is attached. The image output unit 112 may output the display image data and the display tone map information to the display apparatus 500 via another apparatus. The image output unit 112 may record the display image data and the display tone map information in the storage apparatus. Then the display apparatus 500 may read the display image data and the display tone map information from the storage apparatus.

Figure 2:
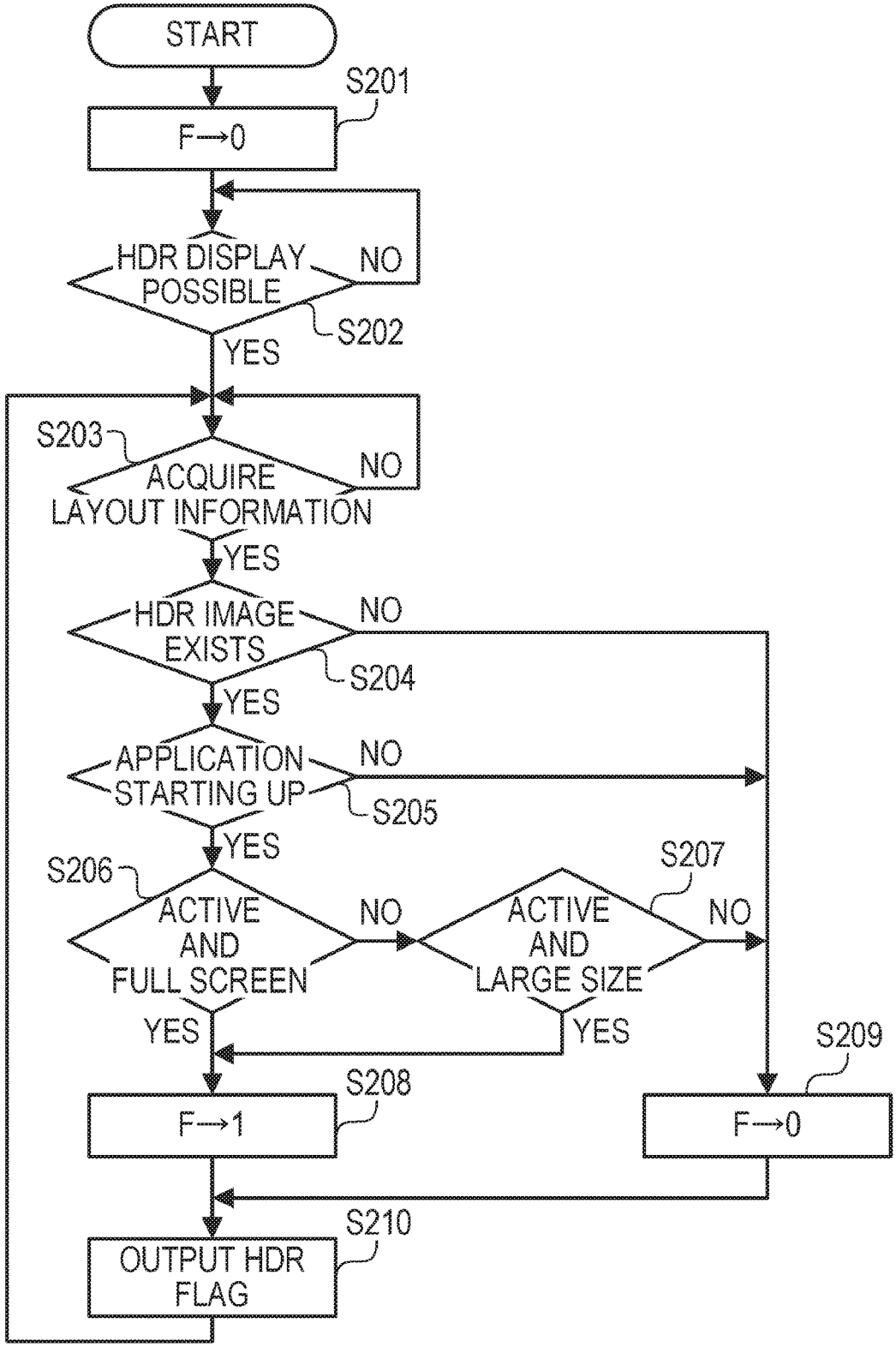
FIG. 2 is an example of a processing flow of an HDR flag generating unit according to Example 1.

An example of the processing flow of the HDR flag generating unit 109 will be described next with reference to FIG. 2. FIG. 2 is a flow chart depicting an example of the processing flow of the HDR flag generating unit 109. The processing flow in FIG. 2 is started, for example, at the timing when the image processing apparatus 100 (operating system (OS) of image processing apparatus 100) is started.

First, in S201, the HDR flag generating unit 109 initializes the HDR flag F to 0. Therefore in this example, when the image processing apparatus 100 is started up, the display tone map information determining unit 110 determines the SDR tone map information as the display tone map information, regardless of the layout. Thereby the display apparatus 500 performs the display based on the SDR tone map information. As a result, performing the display based on the HDR tone map information from the beginning is prevented, that is, performing the high brightness display from the beginning is prevented.

Then in S202, the HDR flag generating unit 109 determines whether the display apparatus 500 can perform the display based on the HDR tone map information, referring to the display performance information output from the EDID acquiring unit 108. For example, the HDR flag generating unit 109 determines that the display apparatus 500 can perform the display based on the HDR tone map information, if the upper limit display brightness of the display apparatus 500 is higher than the brightness threshold Th_L1. If the upper limit display brightness of the display apparatus 500 is the brightness threshold Th_L1 or less, on the other hand, the HDR flag generating unit 109 determines that the display apparatus 500 cannot perform the display based on the HDR tone map information. The brightness threshold Th_L1 is, for example, 1000 nit, or 100 nit defined in the REC. 709 standard, which is conventionally used.

The processing in S202 is repeated until it is determined that the display apparatus 500 can perform the display based on the HDR tone map information. When it is determined that the display apparatus 500 can perform the display based on the HDR tone map information, processing advances to S203. In this example, if the display apparatus 500 cannot perform the display based on the HDR tone map information, the display tone map information determining unit 110 determines the SDR tone map information as the display tone map information regardless of the layout. In concrete terms, the SDR tone map information, which is the display tone map information, is maintained in the case when the display apparatus 500 cannot perform the display based on the HDR tone map information, since the HDR flag F is initialized to 0 in S201. Thereby, the display based on the SDR tone map information is maintained in the display apparatus 500. As a result, use of the HDR tone map information by a display apparatus 500 which cannot perform the display based on the HDR tone map information can be prevented. This in turn can prevent the deterioration of the display caused when the HDR tone map information is used by the display apparatus 500 which cannot perform the display based on the HDR tone map information.

In S203, the HDR flag generating unit 109 waits for the layout information output from the layout detecting unit 107. The processing in S203 is repeated until the layout information is output from the layout detecting unit 107. When the layout information is output from the layout detecting unit 107, processing advances to S204.

In this example, when the layout operation is performed, the layout detecting unit 107 generates and outputs the layout information. In other words, when the layout of the image in the display image data is changed, the layout detecting unit 107 generates and outputs the layout information. The generated layout information is recorded in a register (not illustrated), and the layout information recorded in the register is updated each time the layout is changed. Then the display tone map information is updated by a processing which includes at least the regardless of in S204 to S209. Therefore in this example, processing to update the display tone map information is performed in accordance with the change in the layout.

In this example, the layout information includes the following information I1 to I3.

(I1) HDR presence information to indicate whether the HDR image generated by the HDR image data is disposed in the display image data (I2) Application state information to indicate whether an application to display an HDR image (HDR application) is starting up (I3) Window information on a window which is disposed in the display image data The window information includes an identifier of the window, information to indicate the state of the window, and information to indicate the window size (size of window) in the display image data. In this example, the state of the window can be switched between the selected state (active state) in which the window is selected, and the unselected state (non-active state) in which this window is not selected. The "window disposed in the display image data" can be regarded as the "image disposed in the display image data".

The layout detecting unit 107 may operate only when the application to display the HDR image data (HDR application) is starting up. In this case, the state in which the HDR flag generating unit 109 can acquire the layout information is the state in which the HDR application is starting up, and is the state in which the HDR image data can be displayed.

The layout information is not limited to the above information. The layout information need not include at least one of the HDR presence information, the application state information and the window information. The layout information may include other information. For example, the layout information may include the information on the number of images disposed in the display image data, and the information on the position of the image disposed in the display image data.

In S204, the HDR flag generating unit 109 determines whether the HDR image is disposed in the display image data based on the layout information (HDR presence information) acquired in S203. For this, the determination in S204 is required. If it is determined that the HDR image is disposed, processing advances to S205, and if it is determined that the HDR image is not disposed, processing advances to S209.

In S205, the HDR flag generating unit 109 determines whether the HDR application is starting up based on the layout information (application state information) acquired in S203. If it is determined that the HDR application is starting up, processing advances to S206, and if it is determined that the HDR application is not starting up, processing advances to S209. The processing in S205 may be omitted.

In S206, the HDR flag generating unit 109 determines whether the state is the active state and whether there is an HDR window to be disposed full screen, based on the layout information (window information) acquired in S203. The HDR window is a window to display an HDR image. If it is determined that the state is the active state, and that there is an HDR window to be displayed full screen, processing advances to S208. If it is determined that the state is the active state, and that there is no HDR window to be disposed full screen, processing advances to S207. In the full screen display, the frame of the window may be disposed, or the frame of the window may not be displayed.

In S207, the HDR flag generating unit 109 determines whether the state is the active state, and whether there is an HDR window of which window size is larger than a size threshold Th_S, based on the layout information (window information) acquired in S203. If it is determined that the state is the active state, and that there is an HDR window of which window size is larger than the size threshold (predetermined size) Th_S, processing advances to S208. If it is determined that the state is the active state, and that there is no HDR window of which window size is larger than the size threshold Th_S, processing advances to S209. The size threshold Th_S is, for example, a size corresponding to 70% of the size of the screen of the display apparatus 500.

In S208, the HDR flag generating unit 109 determines HDR flag F=1. In S209, the HDR flag generating unit 109 determines HDR flag F=0. In S210, after S208 or S209, the HDR flag generating unit 109 outputs the HDR flag F determined in S208 or S209 to the display tone map information determining unit 110. Then processing returns to S203. If the HDR flag generating unit 109 outputs HDR flag F=0, the display tone map information determining unit 110 determines the SDR tone map information as the display tone map information. Thereby the display apparatus 500 performs the display based on the SDR tone map information. If the HDR flag generating unit 109 outputs HDR flag F=1, the display tone map information determining unit 110 determines the HDR tone map information as the display tone map information. In this example, the later mentioned data tone map information of a specific image is determined as the display tone map information. Thereby the display apparatus 500 performs the display based on the HDR tone map information.

According to the processing flow in FIG. 2, when a specific image that satisfies the predetermined conditions related to the layout exists as an image disposed in the display image data, HDR flag F=1 is set, and the HDR tone map information is determined as the display tone map information. When the specific image does not exist, HDR flag F=0 is set, and the SDR tone map information is determined as the display tone map information. In this example, the predetermined conditions include the following conditions C1 and C2. Further, in this example, only the HDR image (predetermined type of image) can be the specific image, hence the conditions for the specific image includes the following condition C3. Then an image which satisfies all of the following conditions C1 to C3 is handled as the specific image. In this example, an image in the active state is disposed on the most forward plane, therefor the condition C2 can be regarded as the "image disposed on the most forward plane". Further, an image of which upper limit data brightness is higher than the brightness threshold Th_L2 is regarded as an HDR image (predetermined type of image), therefore the condition C3 can be regarded as the "type of the image is a predetermined type". Furthermore, the condition the "image is disposed to be displayed full screen" can be regarded as the "display image data is constituted by only one type of image".

(C1) The image size (size of image) in the display image data is larger than the size threshold Th_S, or the image is displayed to be disposed full screen.

(C2) The state of the image is active state.

(C3) The upper limit data brightness is higher than the brightness threshold Th_L2.

In this example, the condition C1 is used since the user is more likely to pay attention to an image in the active state. The condition C2 is used since the user is more likely to pay attention to an image of which size is large. Further, it is preferable that the HDR image, which the user is more likely to pay attention to, is displayed in accordance with the HDR tone map information. Therefore in this example, when a specific image that satisfies the conditions C1 to C3 exists, HDR flag F=1 is set, and the HDR tone map information is determined as the display tone map information.

The conditions for the specific image are not limited to the above conditions. For example, the conditions for the specific image need not include one of the conditions C1 to C3. The conditions for the specific image need not include at least one of: the condition that the image size in the display image data is larger than the size threshold Th_S; and the condition that the image is disposed to be displayed full screen. The user is more likely to pay attention to an image displayed at a predetermined portion (e.g. center of screen), therefore the conditions for the specific image may include a condition that the image is disposed in a predetermined portion in the display image data.

The method of determining the display tone map information is not limited to the above method. For example, one of the processing in S206 and the processing in S207 may be omitted. In concrete terms, if the display image data includes a plurality of images, and an image thereof, which is disposed on the most forward plane and has a size larger than a predetermined size, is an HDR image, then the HDR tone map information may be determined as the display tone map information. If not, the SDR tone map information may be determined as the display tone map information. If the display image data is constituted only by the HDR image, the HDR tone map information may be determined as the display tone map information, and if not, the SDR tone map information may be determined as the display tone map information.

When the number of images disposed in the display image data is high, the user is more likely to pay attention to a plurality of images. If display is performed in accordance with the HDR tone map information in such a case, the images the user pays attention to may be displayed at a brightness that is higher than necessary. Therefore if the number of images disposed in the display image data is higher than a threshold (a predetermined value), the SDR tone map information may be determined as the display tone map information, regardless of the layout (whether the specific image exists or not). The threshold is 1 or greater integer.

Figure 3:
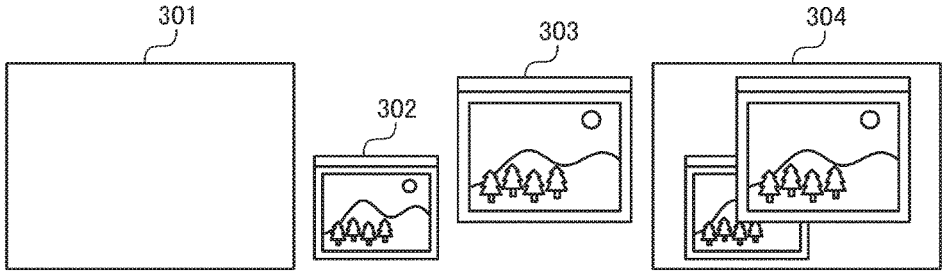
FIG. 3 is an example of a processing of a layout unit according to Example 1.

A concrete example of the processing by the layout unit 106 will be described next with reference to FIG. 3. In this example, the layout unit 106 can generate the display image data by combining a plurality of images. The reference signs 301 to 303 in FIG. 3 indicate a plurality of planes (plurality of images) which are combined by the layout unit 106, and the reference sign 304 indicates a combined plane (display image data).

The plane 301 is a plane of the background image. For example, if the image processing apparatus 100 is a PC, the plane 301 is a plane of wall paper of the onscreen desktop. In combining the planes 301 to 303, the plane 301 is disposed at the bottom (rear most plane).

The plane 302 and the plane 303 are planes of an input image or a stored image respectively. To combine the planes 301 to 303, the planes 302 and 303 are superimposed on the plane 301.

The plane 304 is generated by superimposing the planes 302 and 303 on the plane 301. In plane 304, the plane in the active state is disposed at the top (most forward plane). FIG. 3 is an example when the plane 303 is in the active state. Hence in FIG. 3, the plane 303 is disposed at the top.

A concrete example of the processing by the HDR flag generating unit 109 will be described with reference to FIGS. 2 and 3.

When the plane 301 is used as the plane of the display image data, and the planes 302 and 303 are not the planes of the HDR image, it is determined that the HDR image is not disposed by the processing in S204. Then processing advances from S204 to S209. As a result, HDR flag F=0 is set, and the SDR tone map information is determined as the display tone map information.

When the plane 304 is used as the plane of the display image data, and the plane 303 in the active state is the plane of the HDR image, it is determined whether HDR flag F=1 is set by the processing operations in S206 and S207. In the case of FIG. 3, the plane 303 is not disposed to be displayed full screen. Therefore processing advances from S206 to S207. If the size of the plane 303 is larger than the size threshold Th_S, processing advances from S207 to S208, where HDR flag F=1 is set, and the HDR tone map information is determined as the display tone map information. If the size of the plane 303 is the size threshold Th_S or less, processing advances from S207 to S209, where HDR flag F=0 is set, and the SDR tone map information is determined as the display tone map information.

Figure 5:
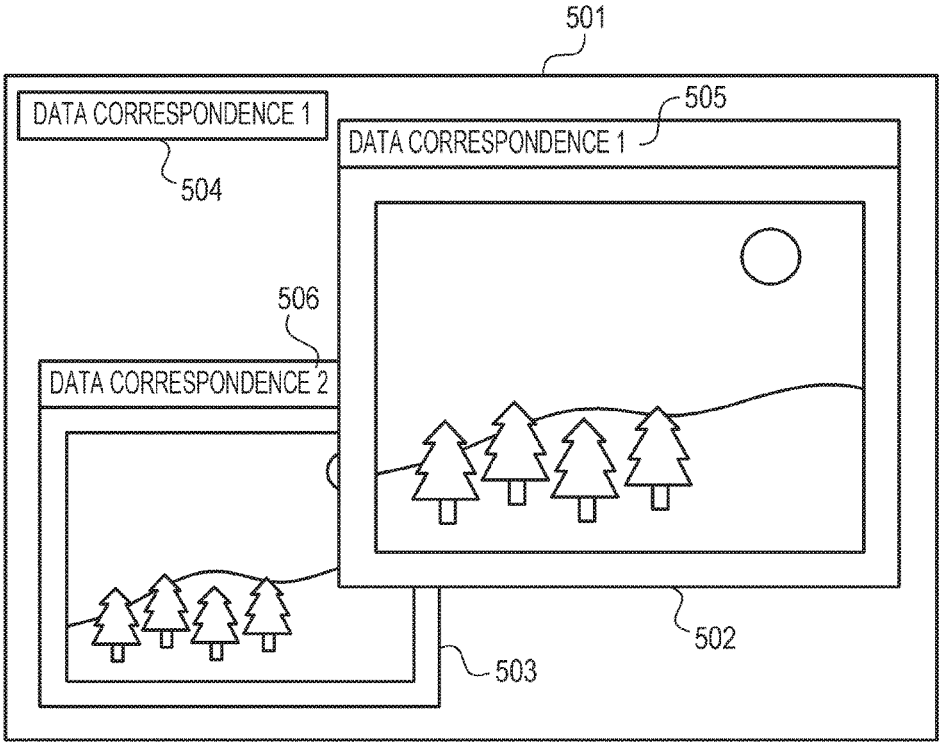
FIG. 5 is an example of the display state of a display apparatus according to Example 1.

A concrete example of the notification of the display correspondence and the data correspondence will be described next with reference to FIG. 5. FIG. 5 shows a display state 501 of display apparatus 500. In the display state 501, windows 502 and 503 are displayed. The window 502 is a window of a specific image, and the data tone map information of the HDR image (specific image) displayed in the window 502 is used as the display tone map information. The data correspondence of the HDR image displayed in the window 502 is a data correspondence 1, and the data correspondence of the image displayed in the window 503 is a data correspondence 2.

In the example in FIG. 5, a graphic image 504, which indicates that the display correspondence is the data correspondence 1, is displayed by the processing of the display tone map information drawing unit 111. Thereby the display correspondence is notified to the user. The graphic image 504 is a text image in which "data correspondence 1" is written.

Further, a graphic image 505, which indicates that the data correspondence of the HDR image displayed in the window 502 is the data correspondence 1, is displayed linking with the window 502 by the processing of the display tone map information drawing unit 111. In the same manner, a graphic image 506, which indicates that the data correspondence of the image displayed in the window 503 is the data correspondence 2, is displayed linking with the window 503. In concrete terms, the graphic image 505 is displayed in the window 502, and the graphic image 506 is displayed in the window 503. The graphic image 505 is a text image in which "data correspondence 1" is written, and the graphic image 506 is a text image in which "data correspondence 2" is written.

The graphic images 504 to 506 are not limited to text images. For example, other graphic images, such as an icon to indicate the display correspondence, may be used for the graphic image 504. Further, other graphic images, such as an icon to indicate the data correspondence, may be used for the graphic images 505 and 506.

As described above, according to this example, a common display correspondence is determined within the screen of the display apparatus, based on the layout of the images in the display image data. Thereby display at an optimum display brightness can be performed using a simple configuration. For example, the display correspondence need not be determined individually for each of a plurality of regions of the screen, therefore the load on the apparatus, the load on the user and the like can be decreased, and display at an optimum display brightness can be implemented. Further, image processing (image processing depending on the display correspondence) need not be performed individually for each of the plurality of regions on the screen, therefore the load on the apparatus, the cost of the apparatus and the like can be reduced, and display at an optimum display brightness can be implemented. Then the display correspondence can be determined so that a display based on the HDR correspondence can be performed only when the user is more likely to pay attention to the HDR image. As a result, performing the display at high brightness for a long time can be prevented, and load on the eye of the user can be reduced.

The optimum display brightness depends on the type of the image, the operating environment of the display apparatus, the user, the intended use of the displayed image and the like. Therefore the method of determining the display correspondence is not limited to the above method. As long as the display correspondence is determined based on the layout, the method of determining the display correspondence is not especially limited. A display correspondence that is different from the HDR correspondence and the SDR correspondence may be determined. The first correspondence is not limited to the HDR correspondence, and the second correspondence is not limited to the SDR correspondence. For example, the first correspondence may be the SDR correspondence, and the second correspondence may be the HDR correspondence. The specific image is not especially limited either. As an image that can be the specific image, an SDR image generated based on the SDR image data may be used.

The display correspondence that is determined when the image processing apparatus is started up need not be the second correspondence. The display correspondence that is determined when the display apparatus cannot perform the display based on the first correspondence is not limited to the second correspondence either. The processing in S202 in FIG. 2 may be omitted.

EXAMPLE 2

Example 2 of the present invention will now be described. In the following, aspects (e.g. configuration, processing) that are different from Example 1 will be described in detail, and description on the same aspects as Example 1 will be omitted. In a display apparatus, a plurality of images may be displayed simultaneously. In such a case, the display brightness of the entire screen may become high, making it difficult for the user to view images.

Figure 6:
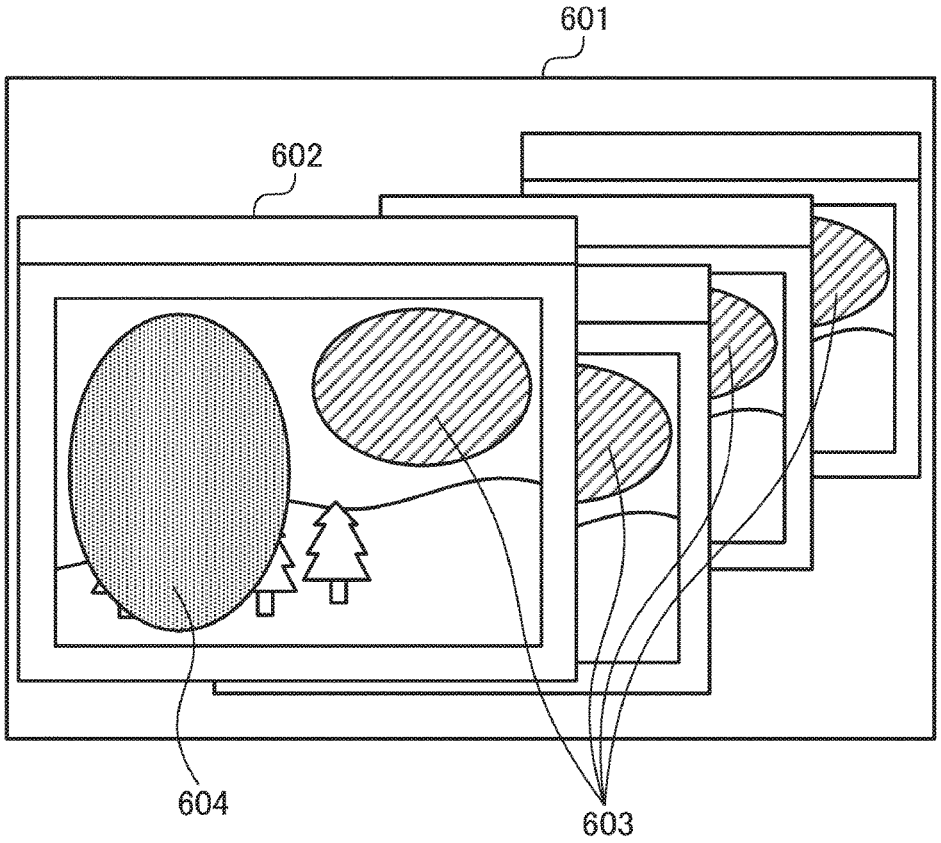
FIG. 6 is an example of the display state of a display apparatus according to Example 2.

A concrete example of the case when the display brightness of the entire screen becomes high will be described with reference to FIG. 6. FIG. 6 shows a display state 601 of the display apparatus. In the display state 601, a plurality of windows are displayed. The window 602 is a window of a specific image, and the data tone map information of the HDR image (specific image) displayed in the window 602 is used as the display tone map information common for the entire screen.

The HDR image displayed in the window 602 is an image conforming to HDR10. In HDR10, maximum content light level (MaxCLL) and maximum frame average light level (MaxFALL) are attached as meta data, which is static data. MaxCLL is meta data that defines the maximum brightness of the HDR image data (maximum data brightness), and Max FALL is meta data which defines the average brightness of the HDR image data (average data brightness). The maximum data brightness of the HDR image data is the maximum value of the data brightness which is used in the HDR image data, and the average data brightness of the HDR image data is the average value of the data brightness which is used in the HDR image data. In the authoring guide line of HDR10, it is specified to limit the image region exceeding 1000 nit to a small sized image region, such as a mirror reflection image region. It is also specified that the average data brightness does not exceed 400 nit.

In FIG. 6, the region 603 is a high brightness region of which display brightness is 1500 to 2000 nit, and the region 604 is a low brightness region of which display brightness is 0 to 50 nit. The HDR image data of the HDR image, which is displayed in the window 602, is created such that the average data brightness does not exceed 400 nit.

However, in the display state 601, a plurality of high brightness regions 603 are displayed, because of a plurality of images which are displayed in the plurality of windows respectively, hence the total size of the high brightness regions is large, and the average display brightness (average value of the display brightness) exceeds 400 nit.

In Example 2, an example to implement a display at an optimum display brightness with higher certainty will be described. According to Example 2, the display brightness of the entire screen can be prevented from becoming too high.

Figure 7:
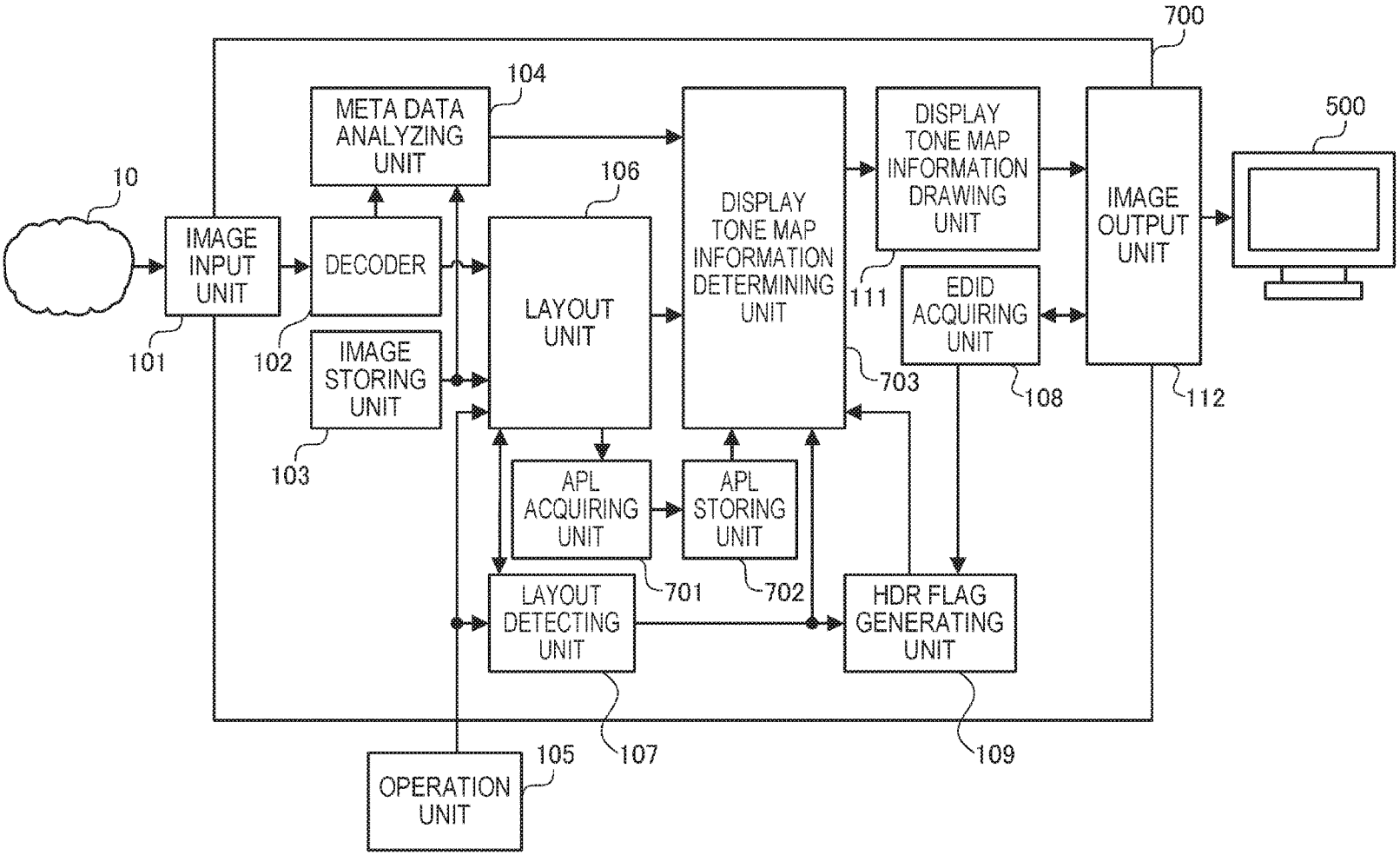
FIG. 7 is a configuration example of an image processing apparatus according to Example 2.

FIG. 7 is a block diagram depicting a configuration example of the image processing apparatus 700 according to Example 2. In FIG. 7, a functional unit, the same as Example 1 (FIG. 1), is denoted with the same reference sign as Example 1. The image processing apparatus 700 further includes an APL acquiring unit 701 and an APL storing unit 702. The processing of the display tone map information determining unit according to Example 2 is different from the processing of the display tone map information determining unit 110 of Example 1, hence the display tone map information determining unit according to Example 2 is denoted with a reference sign 703, instead of the reference sign 110 in Example 1.

Based on the display image data output from the layout unit 106, the APL acquiring unit 701 acquires the average data brightness APL of this display image data. Then the APL acquiring unit 701 records the average data brightness APL in the APL storing unit 702. The average data brightness APL is an average value of the data brightness in one screen. If the display image data is a moving image data, the APL acquiring unit 701 acquires the average data brightness APL for each frame of the display image data. The APL acquiring unit 701 calculates the average data brightness APL using the following Expression 1, for example. In Expression 1, "YDATA" denotes the data brightness of a pixel, "h" denotes the number of pixels in the horizontal direction, "v" denotes the number of pixels in the vertical direction, and Σ(x) denotes a function to calculate the total of x of all pixels. Expression 1 is an expression when the data brightness is a 10-bit value, and by Expression 1, an average data brightness APL, which is at least 0 and not more than 100, can be acquired.

$$APL=(\Sigma(YDATA/(h\times v))/1023)\times 100 \quad \text{(Expression 1)}$$

The method of acquiring the average data brightness APL is not especially limited. For example, if information on the data brightness (e.g. data brightness of each pixel, average data brightness) of an image disposed in the display image data is included in the meta data, the average data brightness APL may be acquired using this information. If a plurality of images are disposed in the display image data, the average data brightness APL may be acquired using a plurality of data correspondences which are set for the plurality of images respectively, or the average data brightness APL may be acquired using one of the plurality of data correspondences. The average data brightness APL may be acquired using the display correspondence, which is determined by the method of Example 1, as the data correspondence.

The APL storing unit 702 stores the average data brightness APL acquired by the APL acquiring unit 701. The APL storing unit 702 is a register or a semiconductor memory, for example.

The display tone map information determining unit 703 performs a similar processing as the display tone map information determining unit 110 of Example 1. A difference is that the display tone map information determining unit 703 determines the display tone map information (display correspondence) also based on the average data brightness APL stored in the APL storing unit 702. In concrete terms, the display tone map information determining unit 703 determines the display tone map information based on the HDR flag F and the average data brightness APL.

Figure 8:
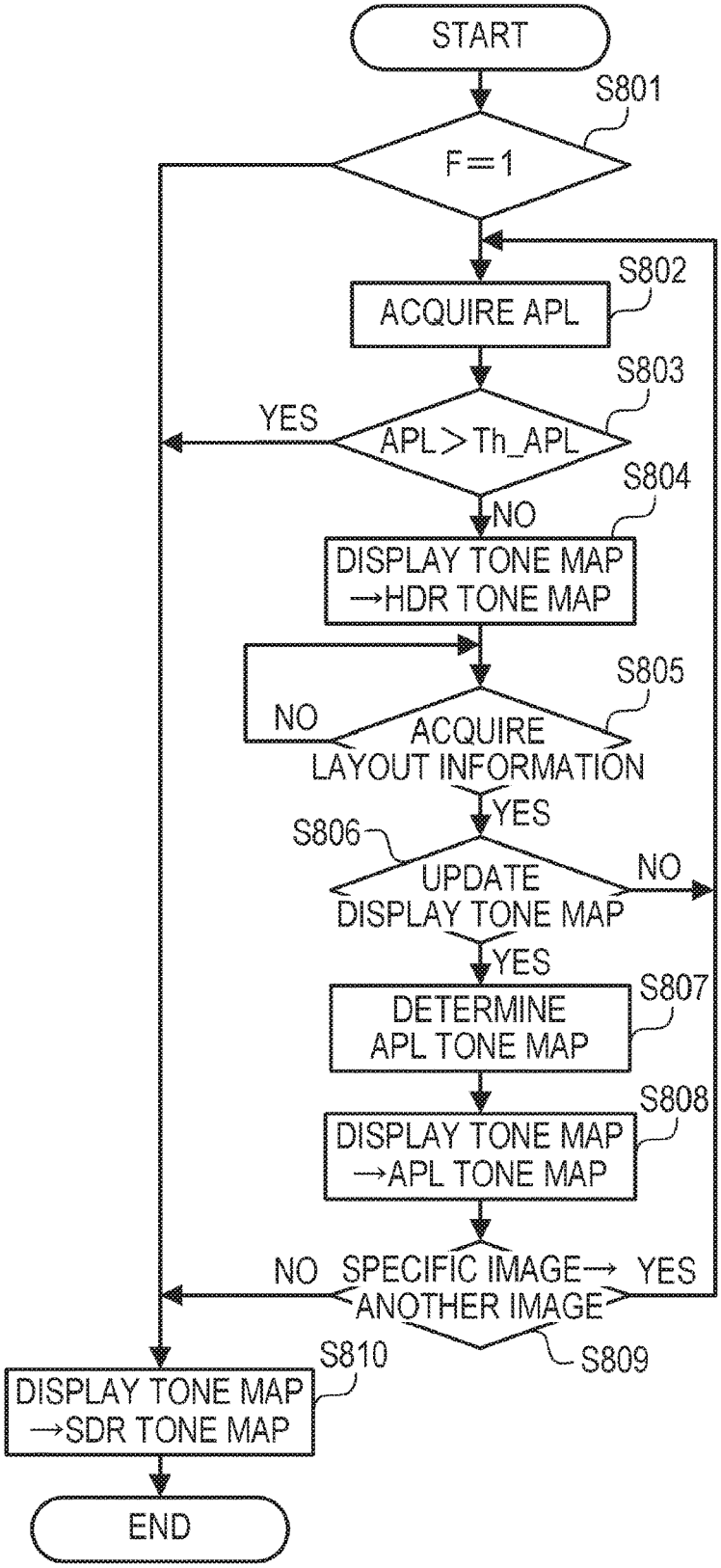
FIG. 8 is an example of a processing flow of a display tone map information determining unit according to Example 2.

An example of the processing flow of the display tone map information determining unit 703 will be described next with reference to FIG. 8. FIG. 8 is a flow chart depicting an example of the processing flow of the display tone map information determining unit 703. The processing flow in FIG. 8 is started at a timing when the HDR flag F is output from the HDR flag generating unit 109, for example.

First, in S801, the display tone map information determining unit 703 determines whether the HDR flag F, output from the HDR flag generating unit 109, is 1. If HDR flag F=1, processing advances to S802, and if HDR flag F=0, processing advances to S810.

In S802, the display tone map information determining unit 703 acquires the current average data brightness APL from the APL storing unit 702. Then in S803, the display tone map information determining unit 703 determines whether the average data brightness APL acquired in S802 is higher than the brightness threshold Th_APL. If the average data brightness APL is not higher than the brightness threshold Th_APL, processing advances to S804, and if the average data brightness APL is higher than the brightness threshold Th_APL, processing advances to S810.

The brightness threshold Th_APL is a value corresponding to 400 nit specified by the authoring guide line of HDR10, for example. In Example 2, the processing operations in S802 and S803 are performed again only when the layout of the image in the display image data is changed. Therefore a value corresponding to a brightness lower than 400 nit may be used as the brightness threshold Th_APL, considering the change of the average data brightness APL caused by the change of the scene of the image disposed in the display image data. For example, a value corresponding to 200 nit may be used as the brightness threshold Th_APL.

In S804, the display tone map information determining unit 703 determines the HDR tone map information, which is the data tone map information of a specific image, as the display tone map information. Thereby the display apparatus 500 performs display based on the HDR tone map information.

Then in S805, the display tone map information determining unit 703 waits for the output of the layout information from the layout detecting unit 107. The processing in S805 is repeated until the layout information is output from the layout detecting unit 107. When the layout information is output from the layout detecting unit 107, processing advances to S806.

In S806, the display tone map information determining unit 703 analyzes the layout information acquired in S805, and determines whether the display tone map information should be updated. For example, when a specific image is changed to another HDR image, or when the specific image no longer exists, the display tone map information determining unit 703 determines that the display tone map information should be updated. Otherwise the display tone map information determining unit 703 determines that the display tone map information should not be updated. If it is determined that the display tone map information should be updated, processing advances to S807, and if it is determined that the display tone map information should not be updated, processing returns to S802.

In S807, the display tone map information determining unit 703 generates the APL tone map information, which is the tone map information to indicate the display correspondence, based on the average data brightness APL acquired in S802. The average data brightness APL used in S807 is the average data brightness of the display image data corresponding to the display tone map information before updating. For example, in S807, the average data brightness APL most recently acquired is used.

The method of generating the APL tone map information is not especially limited. For the method of generating the APL tone map information, various suggested methods can be used. For example, the display tone map information determining unit 703 generates the APL tone map information, so that the upper limit display brightness becomes the average data brightness APL or less. The display tone map information determining unit 703 may generate the APL tone map information by reducing the upper display brightness of the display tone map information, which is determined by the method of Example 1, based on the average data brightness APL.

Then in S808, the display tone map information determining unit 703 determines the APL tone map information generated in S807, as the display tone map information. Thereby the display, based on the APL tone map information, is performed by the display apparatus 500.

Then in S809, the display tone map information determining unit 703 analyzes the layout information acquired in S805, and determines whether the specific image was changed to another HDR image. If it is determined that the specific image was changed to another HDR image, processing returns to S802, and if it is determined that the specific image no longer exists, processing advances to S810.

In S810, the display tone map information determining unit 703 determines the SDR tone map information as the display tone map information. Thereby the display apparatus 500 performs display based on the SDR tone map information.

According to the processing flow in FIG. 8, when the average data brightness APL is higher than the brightness threshold Th_APL, the SDR tone map information is determined as the display tone map information regardless of the layout. Thereby the display brightness on the entire screen can be prevented from becoming high. Further, when the display tone map information is updated to another display tone map information, the display tone map information is determined so that the display tone map information changes from the display tone map information before update to the display tone map information after update via the APL tone map information. Thereby a radical change in the display brightness can be prevented.

Figure 9A:
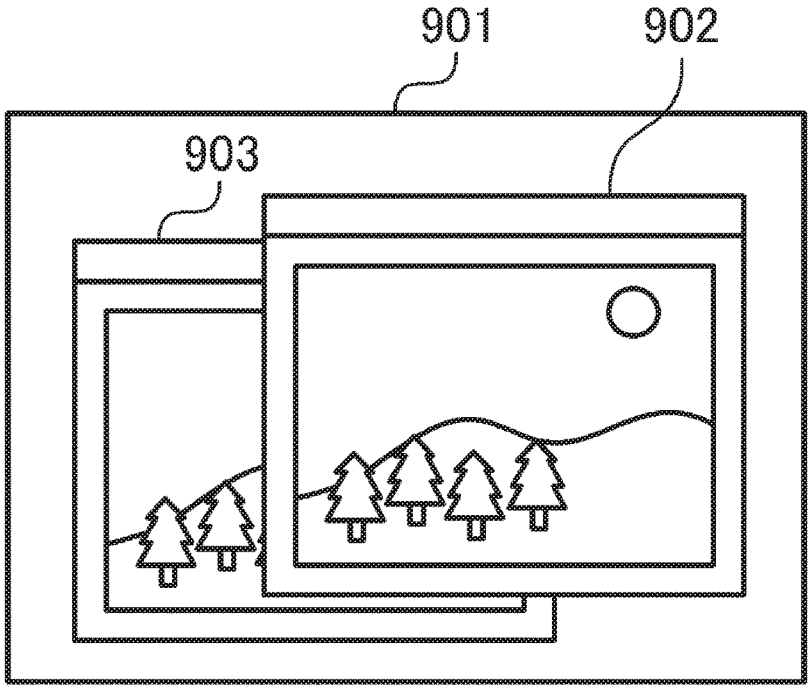
FIGS. 9A and 9B are examples of a display state of the display apparatus according to Example 2.
Figure 9B:
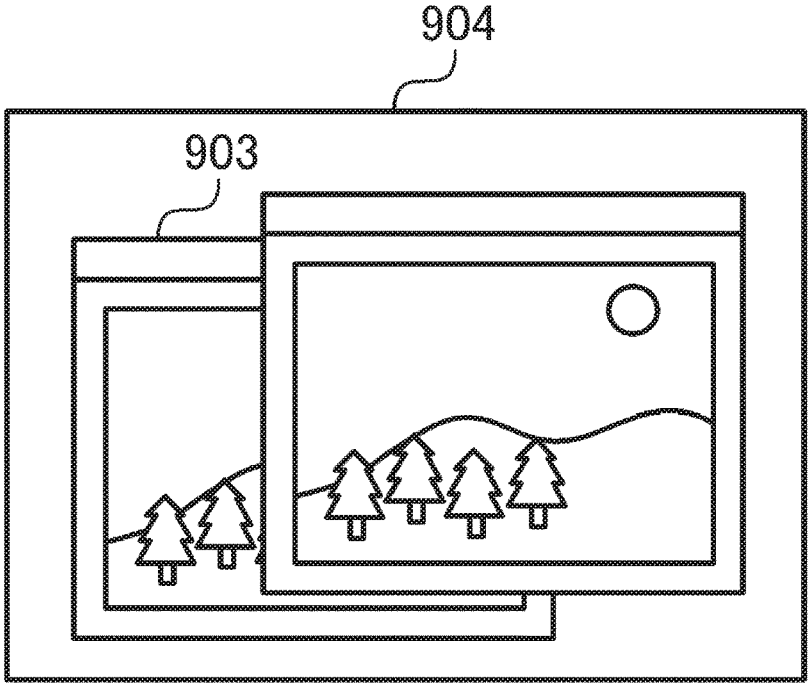

A concrete example of the effect which is obtained by using the APL tone map information generated in S807 as the display tone map information will be described with reference to FIGS. 9A and 9B. FIGS. 9A and 9B show examples of the display state of the display apparatus 500. In the display state 901 in FIG. 9A, windows 902 and 903 are displayed. The window 902 is a window of a specific image, and the data tone map information of the HDR image (specific image) displayed in the window 902 is used as the display tone map information. In the HDR image displayed in the window 902, the upper limit data brightness is 1000 nit, and the average data brightness is 150 nit.

In the display state 901, the data tone map information of the HDR image displayed in the window 902 is used as the display tone map information, hence the HDR image in the window 902 is displayed at 150 nit.

When the user performs the operation to close the window 902, the display state of the display apparatus 500 shifts from the display state 901 to the display state 904 in FIG. 9B. In the display state 904, the window 902 is not displayed, instead the window 903 is displayed. In the window 903, an HDR image, of which upper limit data brightness is 1500 nit and the average data brightness is 400 nit, is displayed. Here in the display state 904, it is assumed that the HDR image in the window 903 is used as the specific image.

When the display state of the display apparatus 500 shifts from the display state 901 to the display state 904, the display tone map information is immediately switched to the data tone map information of the HDR image displayed in the window 903 if the method of Example 1 is used. Therefore the display brightness of the HDR image, which is displayed in the window 903, suddenly changes to a high display brightness (400 nit). As a result, the user has difficulty in viewing the HDR image in the window 903 until the eyes of the user adjust to the high display brightness.

In Example 2, on the other hand, when the display state of the display apparatus 500 shifts from the display state 901 to the display state 904, the display tone map information is changed to the APL tone map information, which is based on the average data brightness APL of the display image data in the display state 901. Then the display tone map information is changed to the data tone map information of the HDR image displayed in the window 903. Thereby the display brightness of the HDR image displayed in the window 903 suddenly changing to a higher display brightness can be prevented. As a result, the user having difficulty in viewing the HDR image in the window 903 can be prevented.

As described above, according to this example, the display correspondence is determined also based on the average data brightness of the display image data. Thereby a display at an optimum display brightness can be implemented with higher certainty. For example, the display brightness of the entire screen becoming high, and the display brightness of the image suddenly changing can be prevented.

The method of determining the display correspondence is not limited to the above method. Instead of the average data brightness of the display image data, the maximum data brightness of the display image data may be used. When the display tone map information is determined, both the average data brightness of the display image data and the maximum data brightness of the display image data may be used. As long as the display correspondence is determined, based on at least one of the maximum data brightness of the display image data and the average data brightness of the display image data, the method of determining the display correspondence is not especially limited.

Instead of the APL tone map information, the tone map information based on the maximum brightness of the display image data corresponding to the display correspondence before update (MAX tone map information), may be used.

When the display tone map information is updated to another display tone map information, the display tone map information determining unit 703 may determine the display tone map information, so that the brightness displayed on the display apparatus 500 gradually changes. For example, in S808, the display tone map information determining unit 703 may determine the display tone map information so that the display tone map information gradually changes to a representative tone map information (e.g. APL tone map information, MAX tone map information). After the processing in S808, the display tone map information determining unit 703 may determine the display tone map information, so that the display tone map information gradually changes from the representative tone map information. The display tone map information determining unit 703 may determine the display tone map information, so that the display tone map information gradually changes from the display tone map information before update to the display tone map information after update via the representative tone map information. The display tone map information determining unit 703 may determine the display tone map information, so that the display tone map information gradually changes from the display tone map information before update to the display tone map information after update, without using the representative tone map information.

The representative data brightness (e.g. maximum data brightness, average data brightness) that is used in S803 in FIG. 8 may be the same as or different from the representative data brightness that is used in S807. For example, the maximum data brightness may be used in S803, and the average data brightness may be used in S807. In this case, the SDR tone map information is determined as the display tone map information regardless of the layout, when the maximum data brightness of the display image data is higher than the brightness threshold, for example. One of the average data brightness and the maximum data brightness may be used in S803, or both of the average data brightness and the maximum data brightness may be used in S803. One of the average data brightness and the maximum data brightness may be used in S807, or both of the average data brightness and the maximum data brightness may be used in S807.

In the processing flow in FIG. 8, the representative data brightness is considered only when the display tone map information before update is the HDR tone map information, but the present invention is not limited to this. For example, the display tone map information may be determined considering the representative data brightness when the display tone map information is updated from the SDR tone map information to the HDR tone map information. The representative data brightness may be considered only in one of the cases when the display tone map information before update is the HDR tone map information, and when the display tone map information before update is the SDR tone map information. The representative data brightness may be considered in both cases when the display tone map information before update is the HDR tone map information and when the display tone map information before update is the SDR tone map information. The representative data brightness may be considered regardless of the display tone map information before update, the display tone map information after update and the like.

EXAMPLE 3

Example 3 of the present invention will be described below. In the following, aspects (e.g. configuration, processing) that are different from Example 1 will be described in detail, and description on the same aspects as Example 1 will be omitted. Here an example of the display apparatus having an image processing apparatus of Example 3 will be described, but the image processing apparatus may be an apparatus that is separate from the display apparatus.

Figure 10:
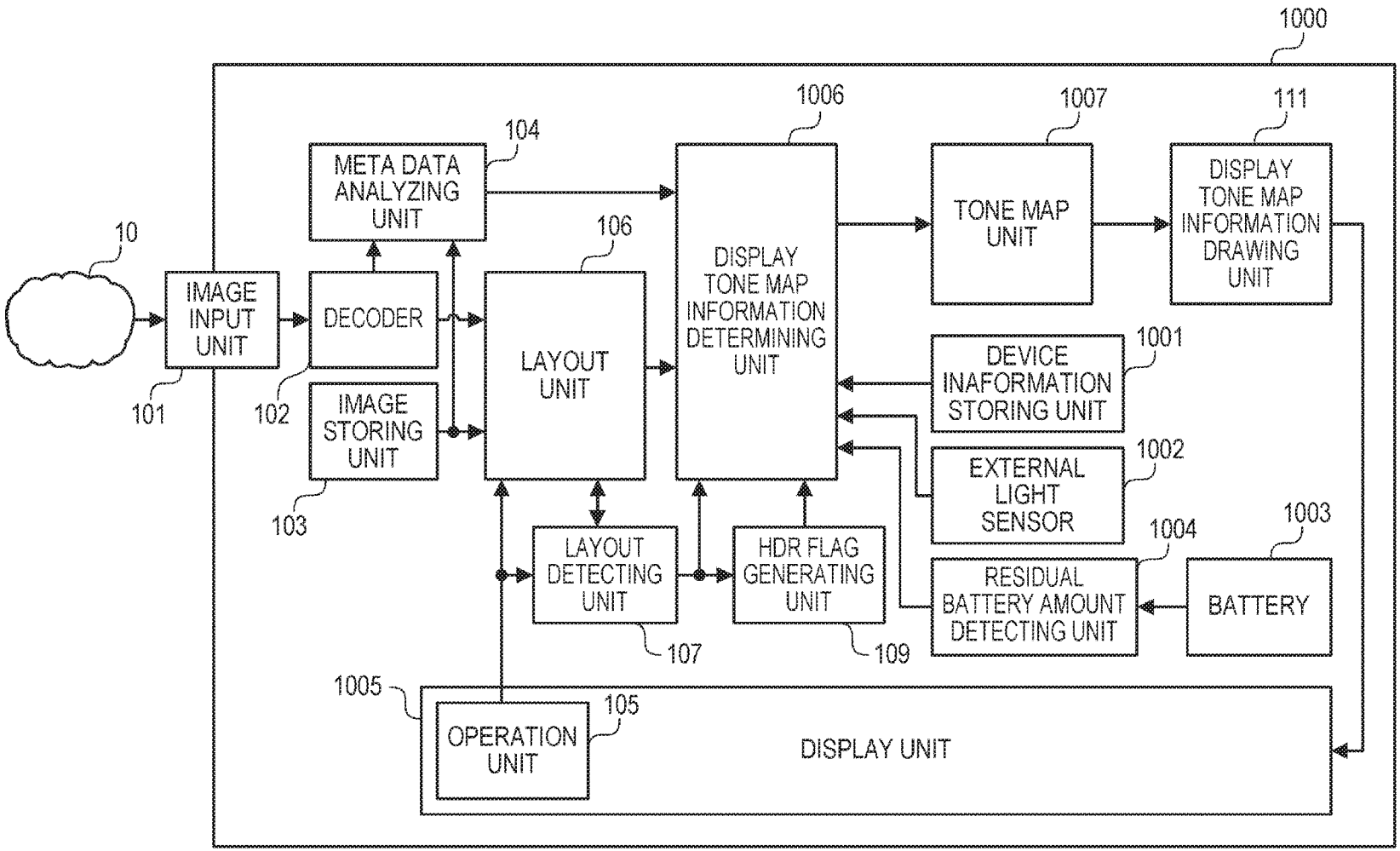
FIG. 10 is a configuration example of a display apparatus according to Example 3.

FIG. 10 is a block diagram depicting a configuration example of the display apparatus 1000 according to Example 3. In FIG. 10, a functional unit the same as the functional unit of the image processing apparatus 100 of Example 1 (FIG. 1) is denoted with the same reference sign. The display apparatus 1000 includes the functional units of the image processing apparatus 100, a device information storing unit 1001, an external light sensor 1002, a battery 1003, a residual battery amount detecting unit 1004, a display unit 1005 and a tone map unit 1007. The display apparatus 1000 does not include the EDID acquiring unit 108 and the image output unit 112 of the image processing apparatus 100. The processing of the display tone map information determining unit according to Example 3 is different from the processing of the display tone map information determining unit 110, hence the display tone map information determining unit according to Example 3 is denoted with a reference sign 1006, instead of the reference sign 110 in Example 1.

In the device information storing unit 1001, information related to the display apparatus 1000 is recorded in advance. The device information storing unit 1001 is, for example, a magnetic disk, an optical disk or a semiconductor memory. In this example, the device information to indicate the type of display unit 1005 is recorded in the device information storing unit 1001 in advance. The type of the display unit 1005 is not especially limited, but is, for example, a liquid crystal panel or an organic light emitting diode (OLED) panel. The OLED panel can be regarded as an "organic EL panel".

The external light sensor 1002 detects the external light to the display apparatus 1000, and outputs the external light information which indicates the detected values of the external light. The external light sensor 1002 detects the illuminance (brightness) of the external light, the color of the external light and the like. The external light sensor 1002 may detect one of the external light illuminance (illuminance of external light) and the external light color (color of external light), or may detect both the external light illuminance and the external light color.

The battery 1003 is a battery to drive the display apparatus 1000. The battery 1003 is a lithium ion battery, for example.

The residual battery amount detecting unit 1004 detects a residual capacity of the battery 1003 (residual battery amount), and outputs the residual battery amount information which indicates the detected value of the residual battery amount.

The display tone map information determining unit 1006 performs a similar processing as the display tone map information determining unit 110 of Example 1. The difference is that the display tone map information determining unit 1006 reads the device information from the device information storing unit 1001, acquires the external light information from the external light sensor 1002, and acquires the residual battery amount information from the residual battery amount detecting unit 1004. Then the display tone map information determining unit 1006 determines the display tone map information (display correspondence) also based on the device information, the residual battery amount information, and the external light information. In concrete terms, the display tone map information determining unit 1006 determines the display tone map information based on the HDR flag F, the device information, the residual battery amount information, and the external light information.

In this example, the display apparatus 1000 (image processing apparatus) has a plurality of operation modes, including at least a brightness fidelity regeneration mode and a visual environment regeneration mode. The operation mode of the display apparatus 1000 is switched depending on, for example, the operation the user performed on the display apparatus 1000 or the type of the image data to be displayed. When the brightness fidelity regeneration mode is set, the display tone map information determining unit 1006 determines the display tone map information using the same method as Example 1. When the visual environment regeneration mode is set, the display tone map information determining unit 1006 determines the display tone map information considering the device information, the residual battery amount information and the external light information as well. In concrete terms, when the visual environment regeneration mode is set, the display tone map information determining unit 1006 changes the HDR tone map information considering the device information, the residual battery amount information, and the external light information.

The tone map unit 1007 performs image processing on the display image data based on the display tone map information determined by the display tone map information determining unit 1006, and outputs the display image data generated after the image processing to the display tone map information drawing unit 111. In concrete terms, the tone map unit 1007 performs the image processing so that the gradation value of the display image data before the image processing is displayed as the display brightness of the display tone map information. In this example, by the processing of the tone map unit 1007, the display brightness of the display unit 1005 is controlled based on the layout of at least one image included in the display image data. For example, the display brightness of the display unit 1005 is controlled to a display brightness corresponding to an image which is disposed on the most forward plane among a plurality of images included in the display image data, and which is larger than a predetermined size. In concrete terms, if an image which is disposed on the most forward plane and is larger than a predetermined size is an HDR image, the display brightness of the display unit 1005 is controlled to a display brightness in a first display brightness range. If not, the display brightness of the display unit 1005 is controlled to a display brightness in a second display brightness range, of which upper limit display brightness is lower than the first display brightness range. The first display brightness range is a range of the display brightness corresponding to the HDR tone map information, and the second display brightness range is the range of the display brightness corresponding to the SDR tone map information.

The display unit 1005 displays an image on the screen in accordance with the display image data input to the display unit 1005 (display image data generated by image processing based on the display tone map information). If the display apparatus and the image processing apparatus are integrated, the touch panel on the screen of the display apparatus can be used as the operation unit 105. Therefore in FIG. 10, the operation unit 105 is included in the display unit 1005.

If the image processing apparatus according to this example is an apparatus that is separate from the display apparatus, the display unit 1005 and the tone map unit 1007 are disposed in the display apparatus. One or more of the device information storing unit 1001, the external light sensor 1002, the battery 1003, and the residual battery amount detecting unit 1004 may be disposed in the display apparatus. And one or more of the device information storing unit 1001, the external light sensor 1002, the battery 1003, and the residual battery amount detecting unit 1004 may be disposed in the image processing apparatus. As long as the image processing apparatus can acquire the device information, the residual battery amount information, the external light information and the like, the configuration to acquire this information is not especially limited.

Figure 11A:
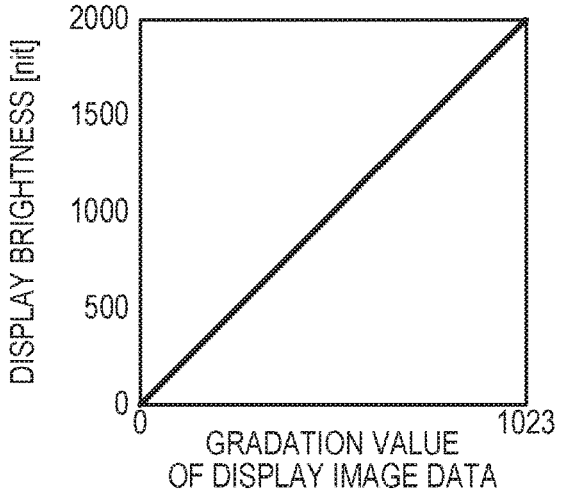
FIGS. 11A to 11C are examples of an HDR correspondence according to Example 3.
Figure 11B:
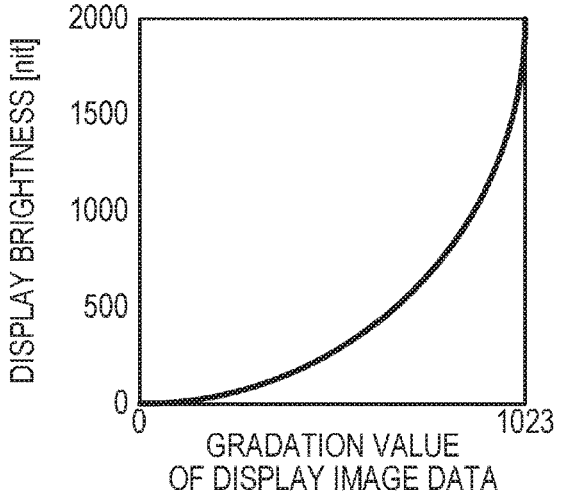
Figure 11C:
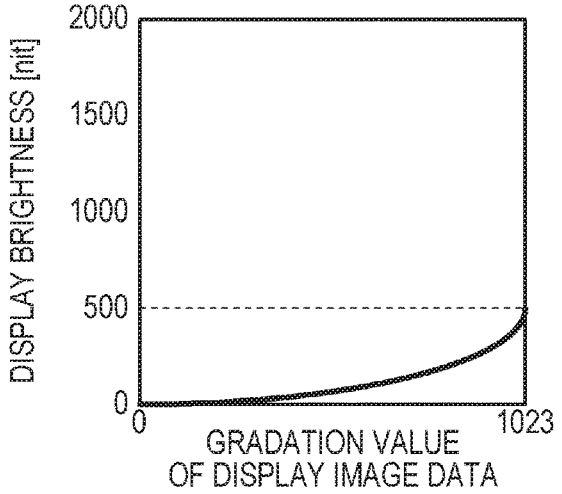

A concrete example of the HDR correspondence (HDR tone map information) in the visual environment regeneration mode will be described with reference to FIGS. 11A to 11C, 12 and 13. FIGS. 11A to 11C are example of the HDR correspondence. In FIGS. 11A to 11C, the ordinate indicates the display brightness, and the abscissa indicates the gradation value of the display image data. The HDR correspondence in the brightness fidelity regeneration mode may be the same as the HDR correspondence in FIG. 11A, or may be the same as the HDR correspondence in FIG. 11B, or may be different from the HDR correspondences in FIGS. 11A and 11B.

An example of changing the HDR correspondence (HDR tone map information) based on the device information will be described first. In the case of an OLED panel (organic EL display apparatus), it is easier to implement a display in which black floating is controlled, a display in which gradation of a dark portion is high, compared with the liquid crystal panel (liquid crystal display apparatus) and the like. Therefore in this example, if the display unit 1005 is an OLED panel, the HDR correspondence in which gradation of the dark portion is higher than the case when the display unit 1005 is the liquid crystal panel, is used. The HDR correspondence in which gradation of the dark portion is high is an HDR correspondence, in which the gradation value assigned to the range of the display brightness in the dark portion is high. For example, when the display unit 1005 is a liquid crystal panel, the HDR correspondence in FIG. 11A is used, and when the display unit 1005 is an OLED panel, the HDR correspondence in FIG. 11B is used. By changing the HDR correspondence based on the device information, display at the optimum display brightness for the type of the display apparatus can be performed.

Figure 12:
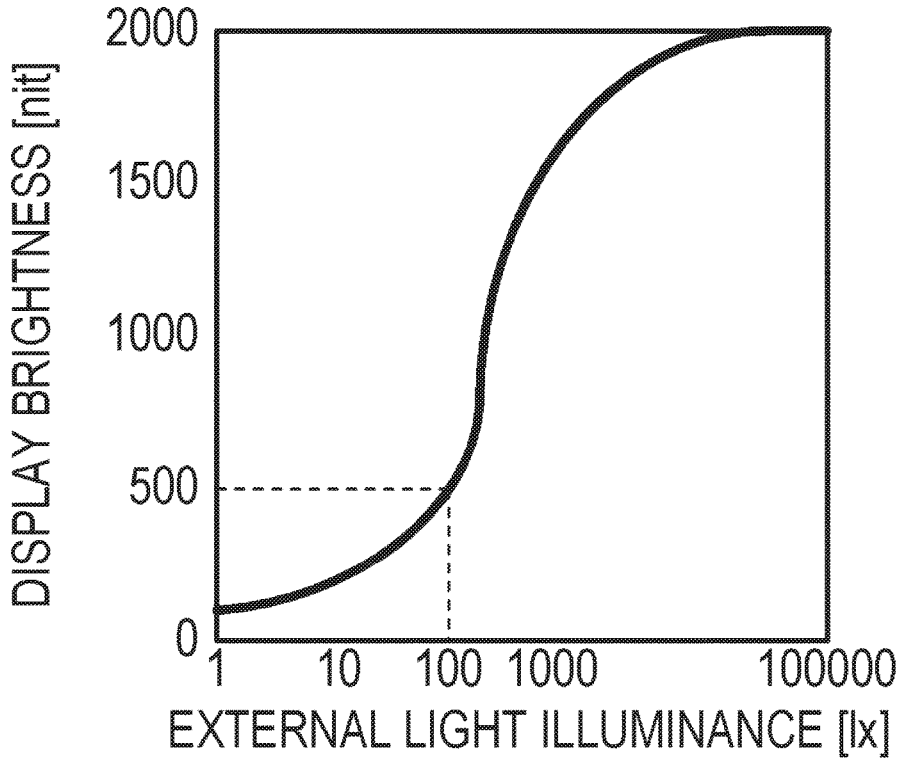
FIG. 12 is an example of a correspondence of the upper limit display brightness and the external light illuminance according to Example 3.

An example of changing the HDR correspondence based on the external light information will be described next. In this example, the information that indicates the correspondence between the upper limit display brightness and the external light illuminance (e.g. function, table) is provided in advance. FIG. 12 is an example of the correspondence between the upper limit display brightness (nit) and the external light illuminance (lx). The ordinate in FIG. 12 is the linear axis to indicate the upper limit display brightness, and the abscissa in FIG. 12 is the logarithmic axis to indicate the external light illuminance. As the external light illuminance increases, visibility of the display decreases. In such a case, the visibility can be improved by increasing the display brightness. Therefore in FIG. 12, the upper limit display brightness is increased as the external light illuminance increases.

In this example, the display tone map information determining unit 1006 determines the upper limit display brightness corresponding to the external light illuminance that is indicated by the external light information using the correspondence in FIG. 12. Then the display tone map information determining unit 1006 changes the HDR correspondence, so that the determined upper limit brightness is used as the upper limit brightness of the HDR correspondence. For example, if the external light illuminance is 100 lx, 500 nit is acquired for the upper limit display brightness, and the HDR correspondence in FIG. 11C is acquired. In the HDR correspondence in FIG. 11C, the display brightness 0 to 500 nit corresponds to the gradation values 0 to 1023. By changing the HDR correspondence based on the external light information, display at the optimum display brightness in accordance with the external light to the display apparatus can be performed.

Figure 13:
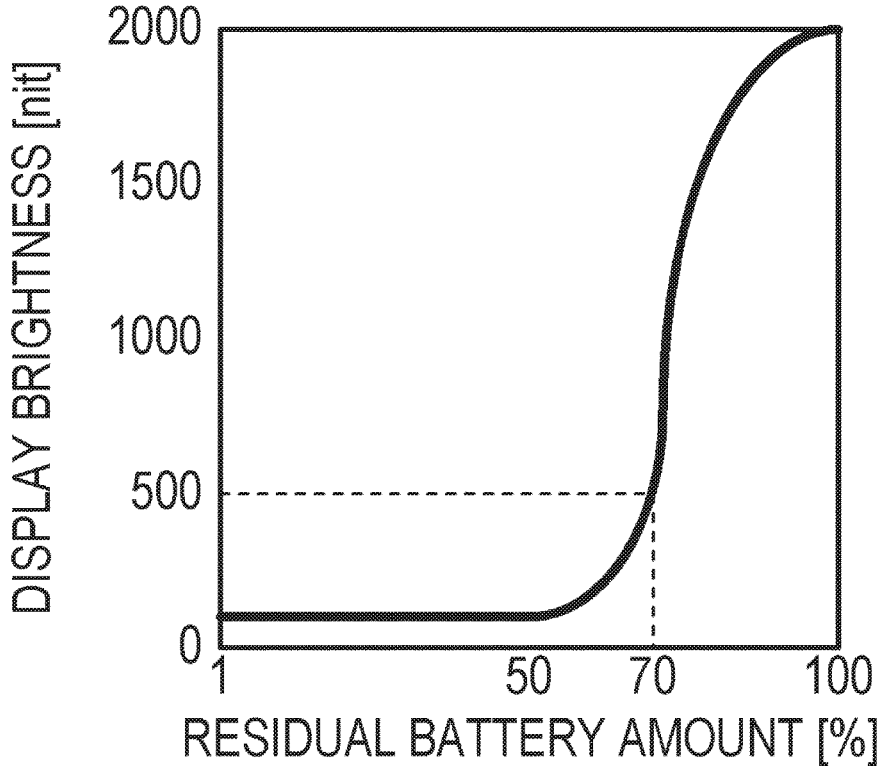
FIG. 13 is an example of a correspondence of the upper limit display brightness and the residual battery amount according to Example 3.

An example of changing the HDR correspondence based on the residual battery amount information will be described next. In this example, information to indicate the correspondence between the upper limit display brightness and the residual battery amount (e.g. function, table) is provided in advance. FIG. 13 is an example of the correspondence between the upper limit display brightness (nit) and the residual battery amount (%). The ordinate in FIG. 13 indicates the upper limit display brightness, and the abscissa in FIG. 13 indicates the residual battery amount. As the residual battery amount drops, the displayable time (residual displayable time) decreases. In such a case, the displayable time can be increased by reducing the display brightness. Therefore in FIG. 13, the upper limit display brightness decreases as the residual battery amount decreases.

In this example, the display tone map information determining unit 1006 determines the upper limit display brightness corresponding to the residual battery amount indicated by the residual battery amount information, using the correspondence in FIG. 13. Then the display tone map information determining unit 1006 changes the HDR correspondence, so that the determined upper limit display brightness is used as the upper limit display brightness of the HDR correspondence. For example, if the residual battery amount indicated by the residual battery amount information is 70%, 500 nit is acquired as the upper limit display brightness, and the HDR correspondence in FIG. 11C is acquired. By changing the HDR correspondence based on the residual battery amount information, display at the optimum display brightness in accordance with the residual battery amount of the display apparatus can be performed.

In this example, the display tone map information determining unit 1006 changes the HDR correspondence considering the device information, the residual battery amount information, and the external light information, so that the above mentioned three types of combinations can be implemented.

The various correspondences are not limited to the correspondences in FIGS. 11A to 11C, 12 and 13. For example, in the case of the display correspondence, the display brightness may change non-linearly with respect to the change in the gradation value, or may change linearly with respect to the change in the gradation value, in a part or in the entire range of the gradation value. In the case of the above mentioned correspondence between the display brightness and the external light illuminance, the display brightness may change non-linearly with respect to the change in the external light illuminance, or may change linearly with respect to the change in the external light illuminance, in a part or in the entire range of the external light illuminance. In the case of the above mentioned correspondence between the upper limit display brightness and the residual battery amount, the display brightness may non-linearly change with respect to the change in the residual battery amount, or may linearly change with respect to the change in the residual battery amount, in a part or in the entire range of the residual battery amount.

The timing to change the HDR correspondence is not especially limited. For example, the HDR correspondence is changed at a timing of starting a display of an HDR image, a timing of changing a scene, a timing of changing a layout or the like. The HDR correspondence may be changed at a timing when a change not less than a threshold is generated in the external light, the residual battery amount or the like.

As described above, according to this example, the display correspondence is determined also based on the type of the display apparatus, the residual battery amount of the display apparatus, and the external light to the display apparatus. Thereby the display at the optimum display brightness is implemented with higher certainty.

The method of determining the display correspondence is not limited to the above method. For example, one or two, out of the type of the display apparatus, the residual battery amount of the display apparatus, and the external light to the display apparatus, need not be considered. The method of determining the display correspondence is not especially limited, as long as the display correspondence is determined based also on at least one of the type of the display apparatus, the residual battery amount of the display apparatus, and the external light to the display apparatus. At least one of the type of the display apparatus, the residual battery amount of the display apparatus, and the external light to the display apparatus, may be considered, regardless of the operation mode of the image processing apparatus. The SDR correspondence may be changed considering at least one of the type of the display apparatus, the residual battery amount of the display apparatus, and the external light to the display apparatus. Only one of the HDR correspondence and the SDR correspondence may be changed. The processing to determine the display correspondence may not be a processing to change the HDR correspondence or the SDR correspondence.

The various thresholds in Examples 1 to 3 may be fixed values determined by the manufacturer in advance, or may be values which the user can change.

Each functional unit of Examples 1 to 3 may or may not be standalone hardware. The functions of two or more functional units may be implemented by common hardware. Each of a plurality of functions of one functional unit may be implemented by standalone hardware. Two or more functions of one functional unit may be implemented by common hardware. Each functional unit may or may not be implemented by hardware. For example, an apparatus may include a processor and a memory in which a control program is stored. The functions of at least a part of the functional units of the apparatus may be implemented by the processor reading the control program from the memory, and executing the control program.

EXAMPLE 4

An image processing apparatus of Example 4 will be described. The image processing apparatus of Example 4 is connected with a display apparatus, and outputs display image data to the display apparatus. The image processing apparatus is an image processing apparatus which can execute at least one application. The image processing apparatus disposes as least one window corresponding to at least one executed application, and generates the display image data.

Further, the image processing apparatus of Example 4 outputs the setting information for setting an upper limit value of the display brightness of the display apparatus. In other words, the image processing apparatus is a control apparatus which controls the upper limit value of the display brightness of the display apparatus. The image processing apparatus controls the display apparatus so that the upper limit value of the display brightness of the display apparatus is higher in the case when the HDR window corresponding to the application to display the HDR image is disposed to satisfy a predetermined condition in the display image data than in other cases. The image processing apparatus of Example 4 will be described in detail.

Figure 14:
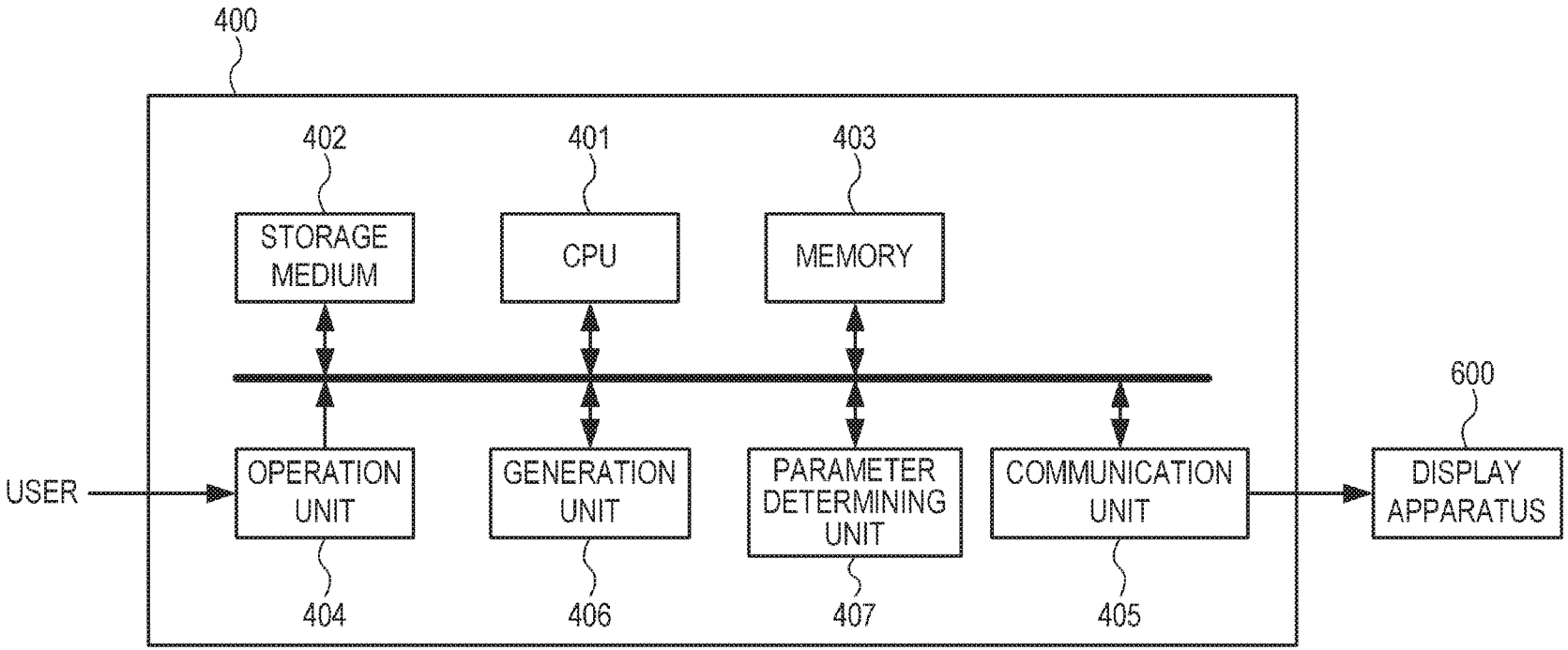
FIG. 14 is a configuration example of an image processing apparatus according to Example 4.

FIG. 14 is a schematic diagram depicting the apparatus configuration which includes the image processing apparatus 400 and the display apparatus 600. The image processing apparatus 400 includes a CPU 401, a storage medium 402, a memory 403, an operation unit 404, a communication unit 405, a generation unit 406, and a parameter determining unit 407. Here the image processing apparatus 400 is assumed to be a personal computer. The image processing apparatus 400 outputs the display image data to the display apparatus 600. The image processing apparatus 400 controls the upper limit value of the display brightness of the display apparatus 600. Just like Example 1, the display apparatus 600 is assumed to be a display which displays an image based on the display image data.

The CPU 401 is a processor which executes a program that is read from the storage medium 402 or the memory 403, so that the image processing apparatus 400 can perform each function to be described below. The CPU 401 may be one processor, or may be constituted by two or more processors. A part of the functions may be executed by hardware.

The CPU 401 can execute one or more application programs recorded in the storage medium 402, and can execute the programs in parallel. The applications which the CPU 401 can execute includes an application to display the HDR image, and an application to display the SDR image. The application to display the HDR image is, for example, a regeneration application to regenerate the HDR content received from an external apparatus using a communication interface (not illustrated). The application to display the SDR image is, for example, an application to create a document.

The storage medium 402 is a storage medium to store the application programs which the CPU 401 can execute, and image data for forming windows corresponding to the application programs. The storage medium 402 is a non-volatile hard disk, for example. The storage medium 402 may be constituted by a plurality of storage media.

The memory 403 is a storage medium to store programs which the CPU 401 executes, parameters and the like.

The operation unit 404 is an operation member which the user can operate. Examples of the operation unit 404 are a mouse and a keyboard. The user can input an operation instruction to the CPU 401 using the operation unit 404. The user can also instruct the CPU 401 on the layout of the window in the display image data using the operation unit 404.

The communication unit 405 is a communication interface to connect with the display apparatus 600. For example, the communication unit 405 is a communication interface conforming to the Display Port standard (registered trademark). The communication unit 405 need not be a communication interface that conforms to this standard. The communication unit 405 can use any communication interface. The communication unit 405 may communicate with a display apparatus 600 via a plurality of transmission lines. The CPU 401 outputs the display image data and the setting value to indicate the upper limit value of the display brightness of the display apparatus 600 via the communication unit 405.

The generation unit 406 is a functional block to generate the display image data. The generation unit 406 generates the display image data by disposing at least one window corresponding to at least one application executed by the CPU 401. The generation unit 406 also determines the layout based on the instruction input via the operation unit 404. The generation unit 406 may determine the layout according to a predetermined condition, instead of an instruction from the user. The instruction to determine the layout is called "layout information" The predetermined condition is, for example, the duration of the non-operation time or a type of the executed application.

The parameter determining unit 407 determines the upper limit value of the display brightness of the display apparatus 600 in according with the control by the CPU 401. The parameter determining unit 407 determines the upper limit value of the display brightness of the display apparatus 600 in accordance with the layout of the window in the display image data generated by the generation unit 406. Here the upper limit value of the display brightness of the display apparatus 600 is the display brightness corresponding to the maximum value of the image data. In concrete terms, if the image data is represented by a 10-bit bit depth, then the display brightness corresponding to the maximum value (1023) of the image data is the upper limit value of the display brightness. The display brightness corresponding to the minimum value (0) of the image data is often the lower limit value of the brightness which the display apparatus 600 can display. Therefore determining the upper limit value of the display brightness of the display apparatus 600 is regarded as determining the range of the display brightness of the display apparatus 600.

The parameter determining unit 407 determines the upper limit value of the display brightness so that the upper limit value of the display brightness of the display apparatus 600 is higher in the case when the HDR window satisfies a predetermined condition in the display image data generated by the generation unit 406 than in other cases. The HDR window is a window corresponding to an application to display an HDR image. The non-HDR window is a window corresponding to an application to display an SDR image, for example. The predetermined condition is at least one of (1) the HDR window is disposed on the most forward plane in the display image data, and (2) the displayed HDR window has at least a predetermined size in the display image data.

For example, the parameter determining unit 407 determines 2000 nit as the upper limit value of the display brightness when the HDR window satisfies the predetermined condition in the display image data. Further, the parameter determining unit 407 determines 100 nit as the upper limit value of the display brightness when the HDR window does not satisfy the predetermined condition in the display image data.

The display apparatus 600 displays an image based on the display image data, in accordance with the setting value to indicate the upper limit value and the display brightness acquired from the image processing apparatus 400. The display apparatus 600 displays an image such that the maximum value of the image data is the upper limit value of the display brightness corresponding to the acquired setting value. In concrete terms, if the upper limit value of the display brightness corresponding to the acquired setting value is 2000 nit, the image is displayed based on the relationship between the image data and the display brightness shown in FIG. 4A. If the upper limit value of the display brightness corresponding to the acquired setting value is 100 nit, the image is displayed based on the relationship between the image data and the display brightness shown in FIG. 4C. Therefore the CPU 401 and the parameter determining unit 407 controlled by the CPU 401 function as a control apparatus to control the upper limit value of the display brightness of the display apparatus.

Figure 15:
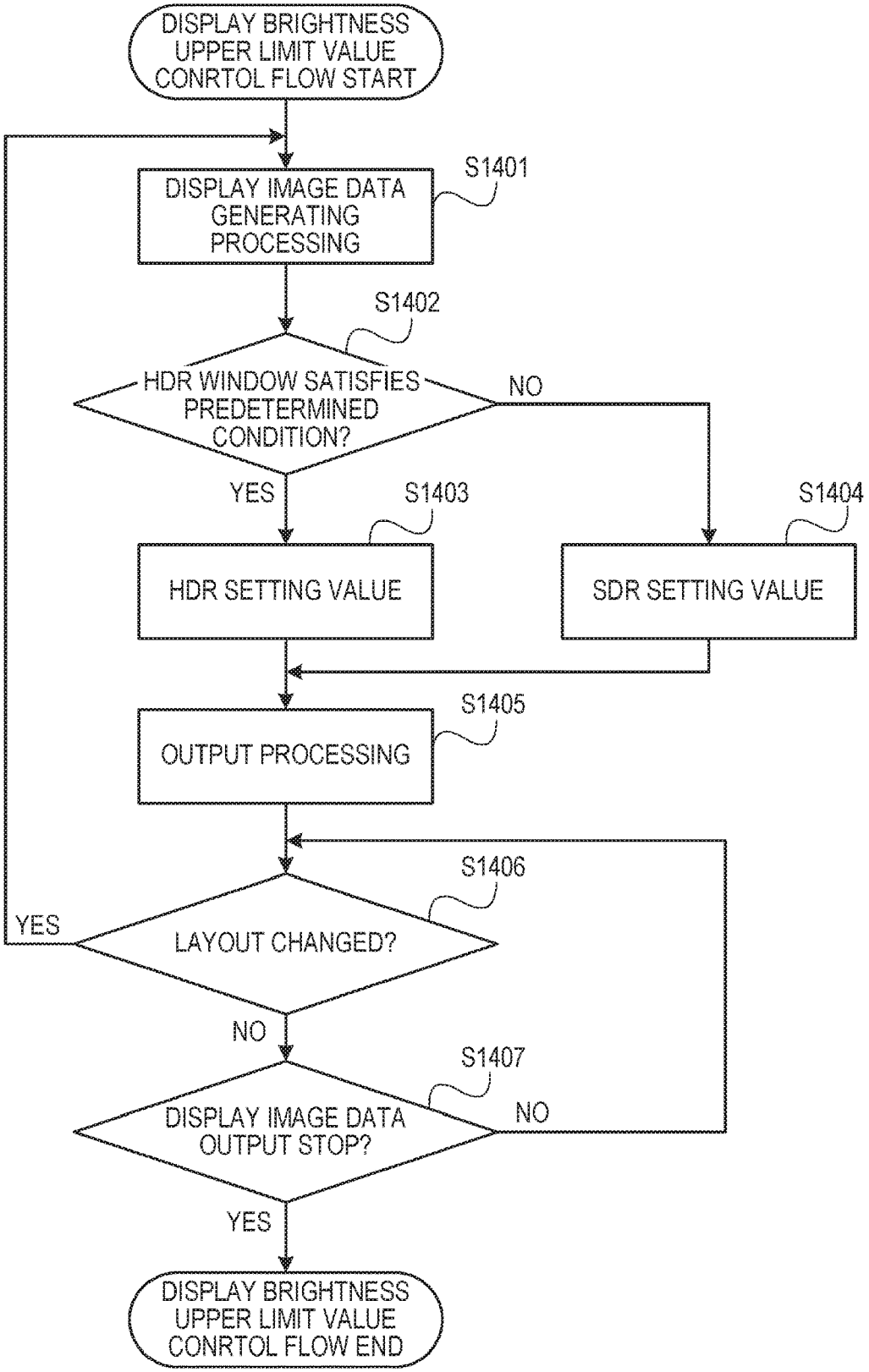
FIG. 15 is an example of a processing flow of the image processing apparatus according to Example 4.

The control flow for the upper limit value of the display brightness of the display apparatus 600, which is executed by the CPU 401, will be described. FIG. 15 is a flow chart depicting the control flow for the upper limit value of the display brightness. This control flow is executed while the image processing apparatus 400 outputs the display image data to the display apparatus 600. It is assumed that the processing by each functional block is performed under an execution instruction by the CPU 401.

In S1401, the generation unit 406 executes the display image data generating processing to generate the display image data based on the application in-execution by the CPU 401 and the layout information.

In S1402, the parameter determining unit 407 executes the determining processing to determine whether the HDR window satisfies a predetermined condition in the display image data. If it is determined that the HDR window satisfies the predetermined condition in the display image data, processing advances to S1403. If not, processing advances to S1404.

In S1403, the parameter determining unit 407 determines the setting value, which indicates the upper limit value of the display brightness, to the HDR setting value. The HDR setting value is 2000 nit, for example.

In S1404, the parameter determining unit 407 determines the setting value, which indicates the upper limit value of the display brightness, to the SDR setting value. The SDR setting value is 100 nit, for example. The HDR setting value is higher than the SDR setting value.

In S1405, the communication unit 405 outputs the display image data and the setting value, which indicates the upper limit value of the display brightness.

In S1406, the CPU 401 determines whether the layout of the window in the display image data is changed. If the layout of the window in the display image data is not changed, processing advances to S1407. If the layout of the window in the display image data is changed, processing returns to S1401.

In S1407, the CPU 401 determines whether the output of the display image data is stopped. The case of stopping the output of the display image data is, for example, a case when the user instructed to stop output of the display image data via the operation unit 404, or a case when a predetermined period has elapsed without input of an instruction from the user via the operation unit 404. If the CPU 401 determines to stop the output of the display image data, the control flow for the display brightness ends. If not, processing returns to S1406, and the CPU 401 continues monitoring whether layout has changed.

Conventionally the image data output from a personal computer is assumed to be SDR image data, and the maximum value of the image data is about 100 nit. However, in the case of a display apparatus that can display an HDR image, the display brightness corresponding to the maximum value of the image data can be a brightness that is higher than conventional display brightness. If the display image data, in which a window corresponding to the conventional application assuming that SDR is displayed on the most forward plane, is displayed on such a display apparatus that can display an HDR image, brightness becomes high on the entire screen, and the user may experience visual discomfort. If the upper limit value of the display brightness is always limited in this display apparatus, on the other hand, the entire image to be displayed may be dark when the application to display an HDR image is executed, and the HDR window is displayed on the most forward plane, or displayed large, and as a result, the characteristics of HDR cannot be expressed.

According to the image processing apparatus of Example 4, the upper limit value of the display brightness of the display apparatus can be set higher in the case when the HDR window, corresponding to the application to display the HDR image in the display image data, satisfies a predetermined condition than in other cases. Therefore in the case when the HDR window is mainly displayed, the upper limit value of the display brightness of the display apparatus becomes higher than in other cases, and display can be performed quite well expressing the characteristics of the HDR image. In the case when the HDR window is not mainly displayed, the upper limit value of the display brightness of the display apparatus can be limited, so that an image assuming SDR is not displayed at high brightness.

The parameter determining unit 407 may set the correspondence between the image data and the display brightness as in the case of Example 1. In this case, as shown in FIG. 4B, the correspondence between the image data and the display brightness may be set in a relationship that is different from the above mentioned relationship.

The setting value (HDR setting value), which indicates the upper limit value of the display brightness determined by the parameter determining unit 407, may be determined in accordance with the range of the brightness that the display apparatus 600 can display, the illuminance of the external light, and the residual battery amount, as described in Example 3.

The image processing apparatus 400 and the display apparatus 600 may be the same apparatus. For example, the processing of this example can be executed by various electronic apparatuses having the image processing apparatus 400 and the display apparatus 600, such as a smartphone, tablet terminal, a personal computer and a digital camera.

Examples 1 to 4 are only examples, and configurations obtained by appropriately modifying or changing the configurations of Examples 1 to 4 within the scope of the essential substance of the present invention are included in the present invention. The configurations obtained by appropriately combining the configurations of Examples 1 to 4 are also included in the present invention.

<Other Embodiments>

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment (s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-005877, filed on Jan. 17, 2017, and Japanese Patent Application No. 2017-235996, filed on Dec. 8, 2017, which are hereby incorporated by reference herein in their entirety.

What is claimed is:

1. An image processing apparatus, comprising at least one processor and/or at least one circuit to perform the operations of the following units:

a generation unit configured to generate display image data by combining a plurality of images;

a determination unit configured to determine, based on a layout of at least one image included in the display image data, a display correspondence, which is a correspondence between a gradation value of the display image data and a display brightness in a case where a display panel displays an image based on the display image data; and an output unit configured to output to the display panel the display image data and information indicating the display correspondence, wherein the determination unit determines a first correspondence as the display correspondence in a case where a specific image, which is a predetermined type of image, is disposed on the most forward plane among the plurality of images included in the display image data, and the determination unit determines a second correspondence, the range of the display brightness of which is different from that of the first correspondence, as the display correspondence in a case where the specific image is not disposed on the most forward plane among the plurality of images included in the display image data.

2. The image processing apparatus according to claim 1, wherein the determination unit determines the first correspondence as the display correspondence in a case where the specific image is disposed on the most forward plane among the plurality of images included in the display image data and is larger than a predetermined size in the display image data, and the determination unit determines the second correspondence as the display correspondence in a case where the specific image is not disposed on the most forward plane among the plurality of images included in the display image data and is not larger than the predetermined size in the display image data.

3. The image processing apparatus according to claim 1, wherein the predetermined type of image is an image supporting a high dynamic range.

4. The image processing apparatus according to claim 1, wherein the predetermined type of image is an image in a data format specified by the SMPTE ST2084 standard, or an image in a data format specified by the Hybrid Log Gamma standard.

5. The image processing apparatus according to claim 1, wherein the upper limit of the display brightness corresponding to the second correspondence is lower than the upper limit of the display brightness corresponding to the first correspondence.

6. The image processing apparatus according to claim 1, wherein in a case where the number of images included in the display image data is greater than a predetermined number, the determination unit determines the second correspondence as the display correspondence regardless of the layout.

7. The image processing apparatus according to claim 1, wherein in a case where the average brightness of the display image data is higher than a first threshold, the determination unit determines the second correspondence as the display correspondence regardless of the layout.

8. The image processing apparatus according to claim 1, wherein in a case where the maximum brightness of the display image data is higher than a second threshold, the determination unit determines the second correspondence as the display correspondence regardless of the layout.

9. The image processing apparatus according to claim 1, wherein in a case where the image processing apparatus starts up, the determination unit determines the second correspondence as the display correspondence regardless of the layout.

10. An image processing apparatus, comprising at least one processor and/or at least one circuit to perform the operations of the following units:

a determination unit configured to determine, based on a layout of at least one image included in display image data, a display correspondence, which is a correspondence between a gradation value of the display image data and a display brightness in a case where a display panel displays an image based on the display image data; and an output unit configured to output to the display panel the display image data and information indicating the display correspondence, wherein in a case where the display correspondence is updated to another display correspondence, the determination unit determines the display correspondence so that the brightness displayed by the display panel gradually changes.

11. The image processing apparatus according to claim 1, wherein the determination unit determines the display correspondence, based further on at least any of a type of the display panel, a residual battery amount of the display panel, and an external light to the display pane.

12. The image processing apparatus according to claim 1, further comprising the display panel configured to display an image based on the display image data in accordance with the display correspondence.

13. The image processing apparatus according to claim 10, wherein in a case where the display correspondence is updated to another display correspondence, the determination unit determines the display correspondence so that the display correspondence changes from the display correspondence before update to the display correspondence after update by way of a third correspondence, which is based on the maximum brightness or the average brightness of the display image data corresponding to the display correspondence before update.

14. An image processing method, comprising:

generating display image data by combining a plurality of images;

determining, based on a layout of at least one image included in the display image data, a display correspondence, which is a correspondence between a gradation value of the display image data and a display brightness in a case where a display panel displays an image based on the display image data; and outputting to the display panel the display image data and information indicating the display correspondence, wherein a first correspondence is determined as the display correspondence in a case where a specific image, which is a predetermined type of image, is disposed on the most forward plane among the plurality of images included in the display image data, and a second correspondence, the range of the display brightness of which is different from that of the first correspondence, is determined as the display correspondence in a case where the specific image is not disposed on the most forward plane among the plurality of images included in the display image data.

15. A non-transitory computer readable medium that stores a program, wherein the program causes a computer to execute:

generating display image data by combining a plurality of images;

determining, based on a layout of at least one image included in the display image data, a display correspondence, which is a correspondence between a gradation value of the display image data and a display brightness in a case where a display panel displays an image based on the display image data; and outputting to the display panel the display image data and information indicating the display correspondence, wherein a first correspondence is determined as the display correspondence in a case where a specific image, which is a predetermined type of image, is disposed on the most forward plane among the plurality of images included in the display image data, and a second correspondence, the range of the display brightness of which is different from that of the first correspondence, is determined as the display correspondence in a case where the specific image is not disposed on the most forward plane among the plurality of images included in the display image data.

16. An image processing apparatus configured to output display image data to a display panel configured to display an image based on the display image data, the apparatus comprising at least one processor and/or at least one circuit to perform the operations of the following units:

a generation unit configured to generate the display image data by disposing at least one window corresponding to at least one application to display an image; and a control unit configured to control an upper limit value of the display brightness of the display panel in accordance with the disposition of at least one window in the display image data, wherein the control unit performs control so that the upper limit value of the display brightness is higher in a case where a predetermined window corresponding to an application to display an HDR image satisfies a predetermined condition in the display image data than in a case where the predetermined window does not satisfy the predetermined condition in the display image data.

17. The image processing apparatus according to claim 16, wherein the control unit performs control so that the upper limit value of the display brightness is higher in a case where the predetermined window is disposed with at least a predetermined size in the display image data than in a case where the predetermined window is not disposed with at least the predetermined size in the display image data.

18. The image processing apparatus according to claim 16, wherein the control unit performs control so that the upper limit value of the display brightness is higher in a case where only the predetermined window is disposed in the display image data than in a case where the display image data is including at least one window that is not corresponding to an application to display an HDR image.

19. The image processing apparatus according to claim 16, further comprising the display panel configured to display an image based on the display image data.

20. The image processing apparatus according to claim 16, wherein the control unit performs control so that the upper limit value of the display brightness is higher in a case where the predetermined window is disposed on the most forward plane in the display image data than in a case where the predetermined window is not disposed on the most forward plane in the display image data.

21. An image processing apparatus, comprising at least one processor and/or at least one circuit to perform the operations of the following units:

a generation unit configured to generate a display image data by combining a plurality of images;

a determination unit configured to determine, based on a layout of at least one image included in the display image data, a display correspondence, which is a correspondence between a gradation value of the display image data and a display brightness in a case where a display panel displays an image based on the display image data; and an output unit configured to output to the display panel the display image data and information indicating the display correspondence, wherein the determination unit determines a first correspondence as the display correspondence in a case where a specific image, which is a predetermined type of image, is larger than a predetermined size in the display image data, and the determination unit determines a second correspondence, the range of the display brightness of which is different from that of the first correspondence, as the display correspondence in a case where the specific image is not larger than the predetermined size in the display image data.

* * * * *